US006267628B1

(12) United States Patent
Meckley et al.

(10) Patent No.: US 6,267,628 B1
(45) Date of Patent: Jul. 31, 2001

(54) HIGH FREQUENCY ELECTRICAL CONNECTOR ASSEMBLY SUCH AS A MULTI-PORT MULTI-LEVEL CONNECTOR ASSEMBLY

(75) Inventors: Ted R. Meckley, Seven Valleys; Ronald Locati, York; Patrick Hulbert, New Providence, all of PA (US)

(73) Assignee: Stewart Connector Systems, Inc., Glen Rock, PA (US)

( * ) Notice: Subject to any disclaimer, the term of this patent is extended or adjusted under 35 U.S.C. 154(b) by 0 days.

(21) Appl. No.: 09/324,164

(22) Filed: Jun. 2, 1999

Related U.S. Application Data

(60) Provisional application No. 60/087,643, filed on Jun. 2, 1998.

(51) Int. Cl.[7] ..... H01R 23/02

(52) U.S. Cl. ..... 439/676; 439/941

(58) Field of Search ..... 439/676, 941, 439/620, 608

(56) References Cited

U.S. PATENT DOCUMENTS

| | | | |
|---|---|---|---|
| 4,641,901 | 2/1987 | Brennan et al. | 339/14 R |
| 4,806,117 | 2/1989 | Johnston | 439/344 |
| 4,904,209 | 2/1990 | Nelson | 439/676 |
| 4,934,961 | 6/1990 | Piorunneck et al. | 439/637 |
| 4,996,766 | 3/1991 | Piorunneck et al. | 29/842 |
| 5,024,609 | 6/1991 | Piorunneck | 439/637 |
| 5,040,991 | 8/1991 | Collier | 439/60 |
| 5,186,647 | 2/1993 | Denkmann et al. | 439/395 |
| 5,226,835 | 7/1993 | Baker, III et al. | 439/403 |
| 5,259,768 | 11/1993 | Brunker et al. | 439/60 |
| 5,269,707 | 12/1993 | Reichardt et al. | 439/630 |
| 5,282,754 | 2/1994 | Kish et al. | 439/108 |
| 5,295,869 | 3/1994 | Siemon et al. | 439/620 |
| 5,299,956 | 4/1994 | Brownell et al. | 439/638 |
| 5,310,363 | 5/1994 | Brownell et al. | 439/676 |
| 5,328,390 | 7/1994 | Johnston et al. | 439/638 |
| 5,362,257 | 11/1994 | Neal et al. | 439/676 |
| 5,403,200 | 4/1995 | Chen | 439/404 |
| 5,456,619 * | 10/1995 | Belopolsky et al. | 439/620 |
| 5,531,612 | 7/1996 | Goodall et al. | 439/541.5 |
| 5,547,405 | 8/1996 | Pinney et al. | 439/894 |
| 5,562,507 | 10/1996 | Kan | 439/676 |
| 5,586,914 | 12/1996 | Foster, Jr. et al. | 439/676 |
| 5,599,209 | 2/1997 | Belopolsky | 439/676 |
| 5,626,497 | 5/1997 | Bouchan et al. | 439/676 |
| 5,639,266 | 6/1997 | Patel | 439/676 |
| 5,639,267 | 6/1997 | Loudermilk | 439/701 |
| 5,697,815 | 12/1997 | Drewnicki | 439/638 |
| 5,791,942 | 8/1998 | Patel | 439/637 |
| 6,017,247 * | 1/2000 | Gwiazdowski | 439/676 |

FOREIGN PATENT DOCUMENTS 9519056 7/1995 (WO) .

* cited by examiner

*Primary Examiner*—Brian Sircus
*Assistant Examiner*—Son V. Nguyen
(74) *Attorney, Agent, or Firm*—Steinberg & Raskin, P.C.

(57) ABSTRACT

A high frequency, modular electrical connector assembly including contact/terminal members arranged in such a manner to reduce crosstalk during use. The connector assembly includes a dielectric housing having a receptacle and an insert assembly arranged therein. The insert assembly includes an insert housing and first, second and preferably third sets of contact/terminal members, each contact/terminal member including a contact portion situated in the receptacle, a terminal portion extending beyond the bottom surface of the insert housing and an intermediate portion interconnecting the contact portion and the terminal portion. The contact/terminal member(s) in each set are geometrically different than the contact/terminal members in the other set(s) and are arranged substantially parallel to one another. The insert housing has conduits in each of which a respective contact/terminal member is received. To reduce crosstalk, the conduits are arranged such that each contact/terminal member is different from any adjacent contact/terminal member(s).

27 Claims, 13 Drawing Sheets

HIGH FREQUENCY ELECTRICAL CONNECTOR ASSEMBLY SUCH AS A MULTI-PORT MULTI-LEVEL CONNECTOR ASSEMBLY

CROSS-REFERENCE TO RELATED APPLICATION

This application claims priority under 35 U.S.C. §119(e) of U.S. provisional patent application Ser. No. 60/087,643 filed Jun. 2, 1998.

FIELD OF THE INVENTION

The present invention relates generally to modular electrical connector assemblies for use in the transmission of high frequency signals and more specifically to multi-port, multi-level connector assembly.

BACKGROUND OF THE INVENTION

Data communication networks are being developed which enable the flow of information to ever greater numbers of users at ever higher transmission rates. However, data transmitted at high rates in multi-pair data communication cables has an increased susceptibility to crosstalk, which often adversely affects the processing and integrity of the transmitted data. The problem of crosstalk in information networks increases as the frequency of the transmitted signals increases.

In the case of local area network (LAN) systems employing electrically distinct twisted wire pairs, crosstalk occurs when signal energy inadvertently "crosses" from one signal pair to another. The point at which the signal crosses or couples from one set of wires to another may be 1) within the connector or internal circuitry of the transmitting station, referred to as "near-end" crosstalk, 2) within the connector or internal circuitry of the receiving station, referred to as "far-end crosstalk", or 3) within the interconnecting cable.

Near-end crosstalk ("NEXT") is especially troublesome in the case of telecommunication connectors of the type specified in sub-part F of FCC part 68.500, commonly referred to as modular connectors. Such modular connectors include modular plugs and modular jacks. The EIA/TIA of ANSI has promulgated electrical specifications for near-end crosstalk isolation in network connectors to ensure that the connectors themselves do not compromise the overall performance of the unshielded twisted pair interconnect hardware typically used in LAN systems. The EIA/TIA Category 5 electrical specifications specify the minimum near-end crosstalk isolation for connectors used in 100 ohm unshielded twisted pair Ethernet type interconnects at speeds of up to 100 MHz.

High speed data transmission cable typically comprise four circuits defined by eight wires arranged in four twisted pairs. The cable is typically terminated by modular plugs having eight contacts, and specified ones of the four pairs of the plug contacts are assigned to terminate respective specified ones of the four cable wire pairs according to ANSI/EIA/TIA standard 568B. The four pairs of plug contacts in turn engage four corresponding pairs of jack contacts. In particular, the standard 568B contact assignment for the wire pair designated "1" is the pair of plug and jack contacts located at the 4–5 contact positions. The cable wires of the pair designated "3" are, according to standard 568, terminated by the plug and jack contacts located at the 3–6 positions which straddle the "4–5" plug and jack contacts that terminate wire pair "1". Near-end crosstalk between wire pairs "1" and "3" during high speed data transmission has been found to be particularly troublesome in connectors that terminate cable according to standard 568.

While it is desirable to use modular connectors for data transmission for reasons of economy, convenience and standardization, such connectors generally comprise a plurality of identically configured electrical contact/terminal members that extend parallel and closely spaced to each other thereby creating the possibility of excessive near-end crosstalk at high frequencies. Specifically, modular jacks generally include a plurality of unitary contact/terminal members made of conductive material and formed to provide a corresponding plurality of closely spaced, substantially parallel contact portions which are adapted to be engaged by blade-like contacts of the modular plugs. Each contact/terminal member is formed to further provide a pin-like terminal portion and an intermediate portion interconnecting the contact and terminal portions. The terminal portion can be connected to the circuit of a printed circuit board. When a modular plug is inserted into the receptacle of a modular jack, the contact blades of the plug engage respective contact portions of the contact/terminal members of the jack. The signals flowing through the contact/terminal members of each transmission circuit create electromagnetic and inductive fields which undesirably couple to other circuits resulting in near-end crosstalk.

Since it has been appreciated that the identical configuration of the contact/terminal members causes crosstalk, several fundamentally different techniques have been developed to vary the shape of the contact/terminal members and thereby reduce crosstalk. A first technique, exemplified by U.S. Pat. Nos. 5,639,266 and 5,791,942 (Patel), incorporated by reference herein, is to form the contact/terminal members so that selective contact portions are forward facing while others are rearward facing while maintaining the contact/terminal members substantially parallel to one another. More particularly, the connector described in the '266 patent includes a contact/terminal member having a contact portion having a free end situated near and facing toward a front of the receptacle ("a forward facing contact portion"), and a contact/terminal member having a contact portion having a free end situated near and facing toward the closed end of the receptacle ("a rearward facing contact portion") whereby the contact/terminal member with the forward facing contact portion inherently has a different shape than the contact/terminal member with the rearward facing contact portion. Crosstalk is reduced by virtue of the different geometry of the contact/terminal members.

A second technique is to construct the contact/terminal members to physically cross-over one another and is exemplified by U.S. Pat. No. 5,362,257 (Neal et al.). In the '257 patent, each contact/terminal member is arranged to cross-over an adjacent contact/terminal member at least once to thereby reduce near-end crosstalk.

Furthermore, as the size of electronic components has become reduced with advances in semiconductor technology, it has become increasingly necessary to increase the number of modular connector ports which can be mounted within a given area.

OBJECTS AND SUMMARY OF THE INVENTION

Accordingly, it is an object of the present invention to provide new and improved connector assemblies for use in data transmission at high frequencies.

Another object of the present invention is to provide new and improved high frequency modular connector assemblies which reduce near-end crosstalk during data transmission.

Still another object of the present invention is to provide new and improved modular connector assemblies for use in Category 5 applications which reduce near-end crosstalk during data transmission.

A still further object of the present invention is to provide new and improved high frequency multi-port, multi-level connector assemblies which reduce near-end crosstalk during data transmission.

Yet another object of the present invention is to provide new and improved modular connector assemblies which provide reduced near-end crosstalk when connected to modular plugs that terminate high speed data transmission cable according to ANSI/EIA/TIA standard 568.

Another object of the invention is to provide new and improved modular connector assemblies in which each contact/terminal member has a different geometry than the contact/terminal member(s) adjacent thereto in order to inhibit the occurrence of near-end crosstalk when adjacent contact/terminal members have essentially the same geometry.

Still another object of the invention is to provide a new and improved insert assembly for mating with an outer housing part to form a plug-receiving receptacle of a jack.

Briefly, these and other objects are attained by modifying the standard construction of modular connector assemblies, which generally comprise a plurality of identically configured contact/terminal members, by providing at least two geometrically different contact/terminal members arranged in the connector assembly so that each contact/terminal member is different than the contact/terminal member(s) adjacent thereto. The connector assembly includes a jack and an optional shield. By geometrically different, it is meant that the contact/terminal members do not have the same overall shape, regardless of the dimensions thereof. To this end, a connector insert assembly is arranged in the jack housing and includes a set of a first form of unitary contact/terminal members, each including a contact portion extending into a plug-receiving receptacle defined in the jack housing, a terminal portion extending beyond a bottom surface of the insert assembly so as to enable electrical connection to a circuit of a printed circuit board, and an intermediate portion interconnecting the contact portion and the terminal portion, and a set of a second form of unitary contact/terminal members, each including a contact portion extending into the receptacle, a terminal portion extending beyond the bottom surface of the insert assembly and an intermediate portion interconnecting the contact portion and the terminal portion. The contact/terminal members in the first set are substantially parallel to and geometrically different from the contact/terminal members in the second set, and the contact/terminal members are positioned in an insert housing of the insert assembly such that each contact/terminal member is different from any adjacent contact/terminal member(s).

When providing geometrically different contact/terminal members arranged substantially parallel to one another, it is desirable to space or distance the contact/terminal members from one another as much as possible, this separation between the contact/terminal members resulting in a reduction in crosstalk between the contact/terminal members. In a preferred embodiment, this is achieved by spacing at least a portion of the conductor portion of each contact/terminal member in the first set from an opposed conductor portion of each contact/terminal member in the second set, while maintaining the generally parallel arrangement of contact/terminal members, i.e., the contact/terminal members in the first and second sets do not cross over one another. For example, the conductor portion of the contact/terminal members in the first set may be situated in a first horizontal plane and at least a portion of the conductor portion of the contact/terminal members in the second set is situated in a second horizontal plane vertically spaced from the first horizontal plane. Thus, at a minimum, the conductor portion of each contact/terminal member in the first set is different than the conductor portion of each contact/terminal member in the second set.

By contrast, the identically configured contact/terminal members in a conventional prior art connector may have the same geometric shape and possibly differ only with respect to the length of the conductor portion, i.e., to allow for terminal portions of the contact/terminal members to be situated in two rows. This difference in length does not provide any vertical separation of the conductor portions of the contact/terminal members.

To accommodate the different contact/terminal members in the insert housing, in an embodiment wherein the receptacle is defined above a top surface of the insert assembly, the insert housing defines first and second sets of conduits, the conduits in each set are the same but the conduits in the first set are different than the conduits in the second set. The conduits in the first set each receive a respective one of the contact/terminal members of the first set and the conduits in the second set each receive a respective one of the contact/terminal members of the second set. The first and second sets of conduits are defined in the insert housing such that adjacent contact/terminal members are different from one another.

In a preferred embodiment, the insert includes a third set of contact/terminal members substantially parallel to the contact/terminal members in the first and second sets and each including a contact portion extending into the receptacle, a terminal portion extending beyond the bottom surface of the insert assembly and an intermediate portion interconnecting the contact portion and the terminal portion. The contact/terminal members in the third set are geometrically different than the contact/terminal members in the first and second sets. The insert housing also includes a third set of conduits which are different than the conduits in the first and second sets of conduits. Each conduit in the third set of conduits receives a respective one of the contact/terminal members of the third set of contact/terminal members. The first, second and third sets of conduits are arranged such that each contact/terminal member is different from any adjacent contact/terminal member(s).

In another preferred embodiment, the contact portion of each contact/terminal member in the first set is inclined and has a free edge facing a rear of the insert housing such that the contact/terminal members in the first set provide a "rearward facing contact portion". The contact portion of each contact/terminal member in the second set is also inclined but has a free edge facing a front of the insert housing such that the contact/terminal members in the second set provide a "forward facing contact portion". The contact/terminal members in the third set, if present, may be constructed to provide either a forward facing or rearward facing contact portion. By positioning a contact/terminal member having a forward facing portion adjacent a contact/terminal member having a rearward facing contact portion, crosstalk is reduced as discussed in the Patel patents referenced above, in addition to the reduction in crosstalk obtained by virtue of the different geometry of the contact/terminal member having a forward facing portion and the contact/terminal member having a rearward facing contact portion.

In accordance with the invention, the insert assembly may include a minimum of two geometrically different contact/terminal members, e.g., from only two different sets of contact/terminal members, or three or more geometrically different contact/terminal members, and which are arranged so that each contact/terminal member is different from any adjacent contact/terminal member(s). If contact/terminal members from only two sets of geometrically different contact/terminal members are used in a connector in accordance with the invention, then the contact/terminal members must be arranged in an alternating pattern. If contact/terminal members from three or more sets of geometrically different contact/terminal members are used in a connector in accordance with the invention, then the number of contact/terminal members from each set may be selected as desired and the contact/terminal members arranged in any desired manner so long as each contact/terminal member is geometrically different from any adjacent contact/terminal member(s).

Preferably, in an eight position, eight contact jack, the contact/terminal members at positions P3 and P5 are contact/terminal members having a forward facing contact portion whereas the contact/terminal members at positions P1, P2, P4, P6, P7 and P8 are contact/terminal members having a rearward facing contact portion. In order to avoid having adjacent contact/terminal members with the same geometry, the contact/terminal members having a rearward facing contact portion at positions P2, P4, P6 and P8 are geometrically different than the contact/terminal members at positions P1 and P7, i.e., from different sets of contact/terminal members.

Any geometrical configurations of contact/terminal members may be used in the invention, which may include either a forward facing contact portion or a rearward facing contact portion, as well as contact/terminal members which cross-over one another. It is important though that in order to reduce crosstalk between the contact/terminal members in the connector in accordance with the invention, each contact/terminal member should be geometrically different from any adjacent contact/terminal member(s), i.e., has a different shape therefrom. This is so at least for the contact/terminal member(s) which are most susceptible to crosstalk. It is thus recognized that some of the contact/terminal members may have the same geometrical configuration as an adjacent contact/terminal member if it is found that providing the adjacent contact/terminal members with different geometrical configurations does not meaningfully reduce crosstalk.

In another preferred embodiment, the insert housing is substantially L-shaped and generally comprises a base part having top and bottom surfaces, front and rear surfaces and opposed lateral surfaces, and a cap part separable from the base part and having top and bottom surfaces, front and rear surfaces and opposed lateral surfaces. The bottom surface of the cap part partially overlies the top surface of the base part such that the cap part extends in a cantilever fashion from the base part. The conduits in the first, second and third sets of conduits are formed in connection with both the base part and the cap part.

The multi-port, multi-level connector assembly for receiving multiple plugs in accordance with the invention which makes use of the insert assembly in any of the embodiments described above includes a jack comprising an outer housing part defining a plurality of receptacles arranged in an upper and lower level, each including at least one receptacle receivable of a respective plug, at least one lower insert assembly arranged in the outer housing part and including a plurality of contact/terminal members which engage contacts on a respective plug upon insertion thereof into a respective receptacle in the lower level, and at least one upper insert assembly arranged in the outer housing part and including a plurality of contact/terminal members which engage contacts on a respective plug upon insertion thereof into a respective receptacle in the upper level. The upper insert assembly is as in any of the embodiments described above.

When used herein, a contact/terminal member includes a contact portion situated in the plug-receiving receptacle, a terminal portion for connection to a substrate and an intermediate or bridging portion connecting the contact portion to the terminal portion. However, when the contact/terminal member is not critical to an embodiment of the invention, instead of a contact/terminal member, an assembly of a contact situated at least partially in the receptacle, a terminal situated at least partially below the lower surface or beyond the rear surface of the connector for connection to a substrate and some other intermediate structure for interconnecting the contact and terminal may be used, e.g., a printed circuit board having a wiring pattern. For example, this would be the case for the multi-level connector assembly described herein wherein the lower insert assembly is not required to include contact/terminal members but may include separate contacts and terminals.

BRIEF DESCRIPTION OF THE DRAWINGS

A more complete appreciation of the present invention and many of the attendant advantages thereof will be readily understood by reference to the following detailed description when considered in connection with the accompanying drawings in which.

DETAILED DESCRIPTION OF THE PREFERRED EMBODIMENTS

Figure 1:
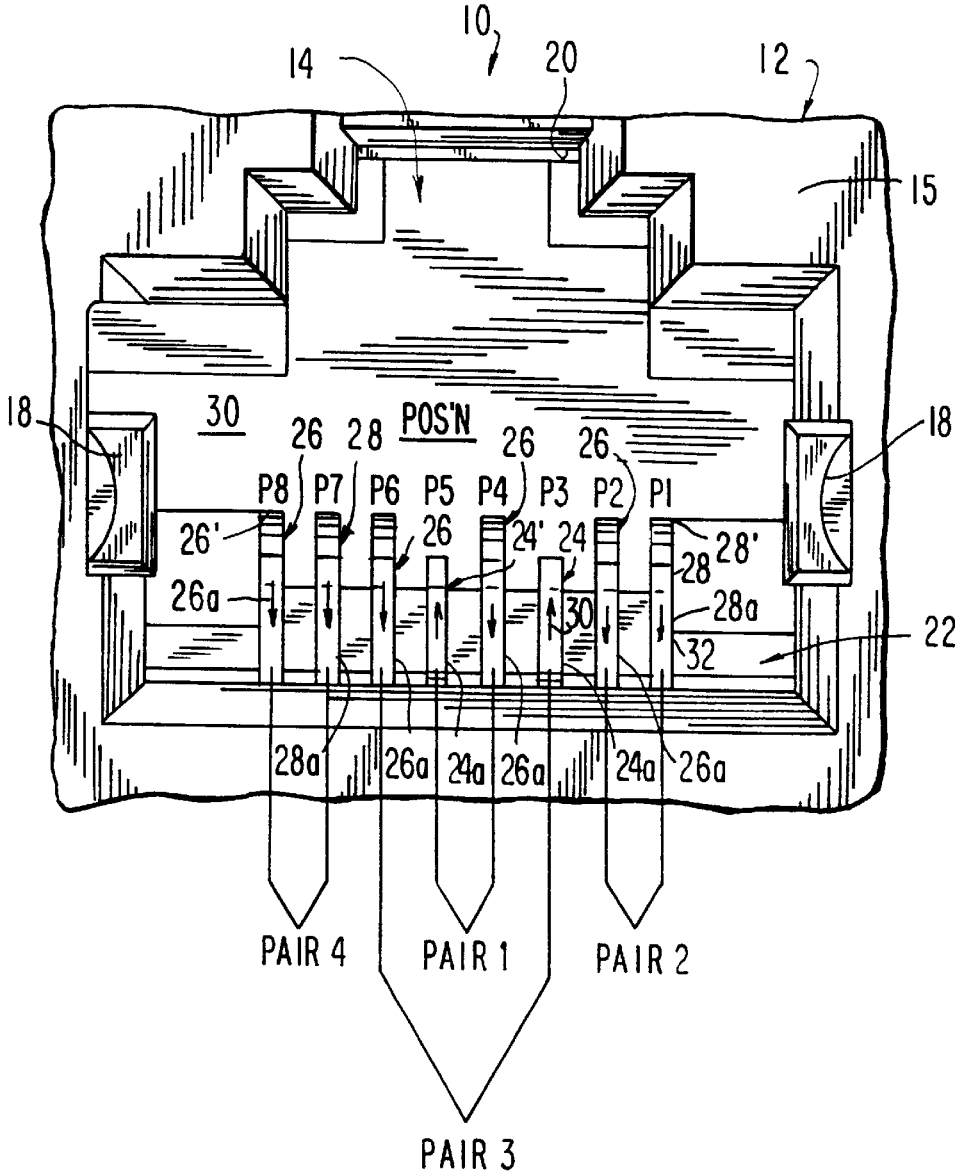
FIG. 1 shows a front elevation view of a plug-receiving receptacle of a connector assembly in accordance with the invention.
Figure 2:
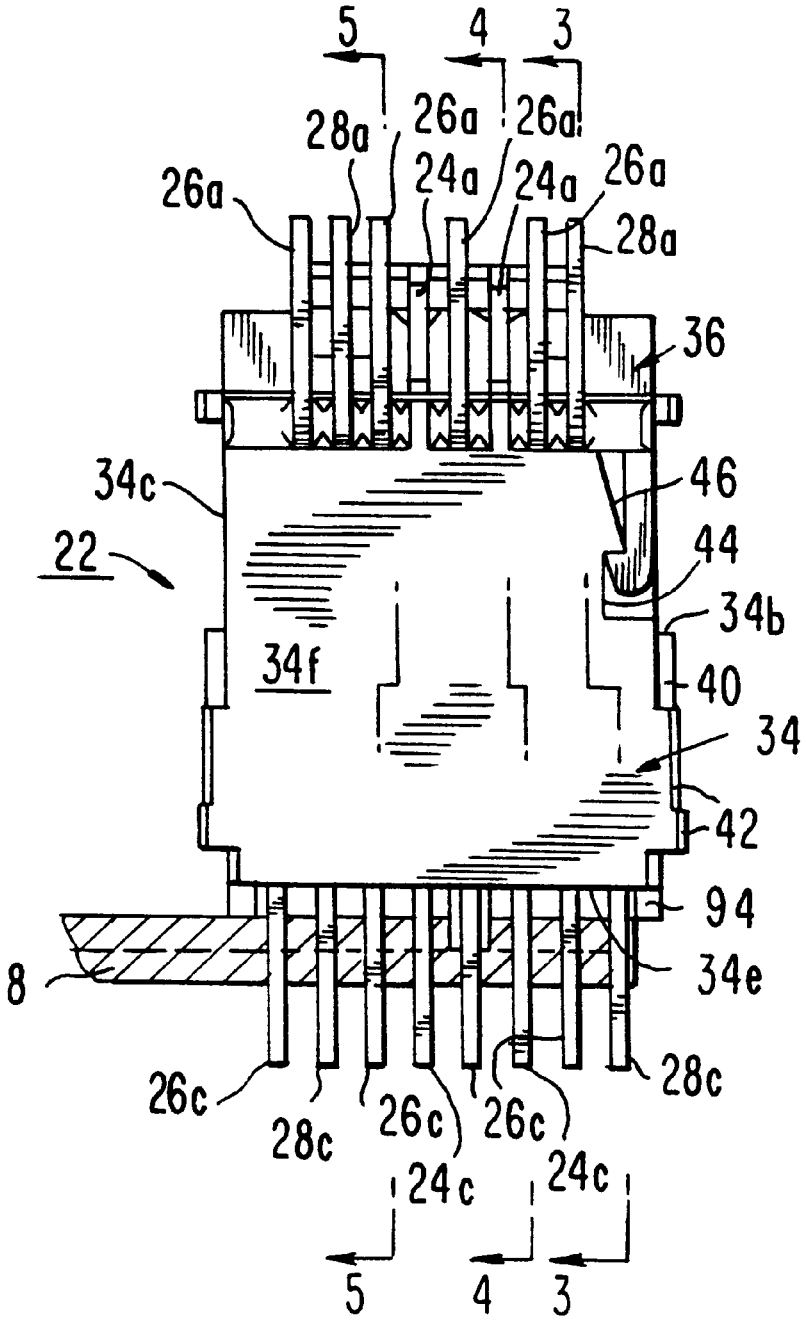
FIG. 2 shows a front view of a modular connector insert assembly for a connector assembly in accordance with the invention.

Referring now to the drawings wherein like reference characters designate identical or corresponding parts throughout the several views, FIG. 1 shows a portion of a front face 15 of a connector assembly 10 in accordance with the invention having a plug-receiving receptacle 14 which is configured to receive a compatible modular connector plug (not shown). Connector assembly 10 comprises a dielectric housing 12 having walls defining the plug-receiving receptacle 14. The walls of the housing 12 may be in any form and size and the front portion of the connector assembly 10 may even be disposed within the cut-out of a face-plate of a larger housing.

Housing 12 includes guide shoulders 18 and a latching member 20 for facilitating entry and retention of the plug in the receptacle 14. An insert assembly in accordance with the invention, designated 22, is arranged at least partially in housing 12 and includes a two-part insert housing 30 and a plurality of conductive means for providing an electrical connection between the plug-receiving receptacle and a substrate such as a printed circuit board onto which the connector assembly 10 is mounted. The conductive means include a first set of contact/terminal members 24, a second set of contact/terminal members 26 and a third set of contact/terminal members 28, all of which retained by the insert housing 30 in a generally parallel arrangement. The three sets of contact/terminal members 24,26,28 are geometrically different from one another and arranged in conjunction with the insert housing 30 in order to provide that each contact/terminal member in the connector assembly 10 has a different geometry than any adjacent contact/terminal member(s) and thereby reduce crosstalk between the contact/terminal members. The structure of the insert assembly 22 is described below with reference to FIGS. 2–9.

Connector assembly 10 includes eight such contact/terminal members 24,26,28 (two contact/terminal members 24, four contact/terminal members 26 and two contact/terminal members 28) and is constructed specifically for use with an eight contact modular plug terminating a four wire pair transmission cable with wire-contact assignments as specified by ANSI/EIA/TIA standard 568B. As shown in FIG. 1, a contact/terminal member 24 is arranged at positions P3 and P5, a contact/terminal member 26 is arranged at positions P2, P4, P6 and P8 and a contact/terminal member 28 is arranged at positions P1 and P7. The contact/terminal members 26,24 at positions 4 and 5, respectively, engage the contacts of the plug and form wire pair "1", the contact/terminal members 28,26 at positions 1 and 2, respectively, engage the contacts of the plug and form wire pair "2", the contact/terminal members 24,26 at positions 3 and 6, respectively, engage the contacts of the plug and form wire pair "3" and the contact/terminal members 28,26 at positions 7 and 8, respectively, engage the contacts of the plug and form wire pair "4". However, it is understood that a connector in accordance with the principles of the invention may include more or less than eight contact/terminal members and thus a different wire-contact assignment.

The contact/terminal members situated at positions P1–P8 are thus as follows:

| Position | P8 | P7 | P6 | P5 | P4 | P3 | P2 | P1 |
|---|---|---|---|---|---|---|---|---|
| Contact/terminal Member | 26 | 28 | 26 | 24 | 26 | 24 | 26 | 28 |

From the chart, it can be easily appreciated that each contact/terminal member is different than the adjacent contact/terminal member(s). Designating the contact/terminal members 24 as "F", the contact/terminal members 26 as "R1" and the contact/terminal members 28 as "R2" (the reason for such designations relates to the orientation of the contact portion of the contact/terminal member as discussed below), this arrangement would be R2, R1,F,R1,F, R1,R2,R1 (corresponding to positions P1–P8). Other arrangements of the three geometrically different contact/terminal members 24,26,28 are possible so long as each contact/terminal member is different from any adjacent contact/terminal member(s). This would of course require modifications to, e.g., the insert housing 30 of the insert assembly 22.

Each contact/terminal member 24,26,28 is made of a resilient conductive material and includes a contact portion 24*a*,26*a*,28*a*, respectively, which extends into the receptacle 14 to allow engagement with a respective contact of the plug when the plug is present in the receptacle 14. A gold layer (not shown) may be deposited on the actual portion of the contact portions 24*a*,26*a*,28*a* which engage the contacts of the plug in order to increase the electrical coupling between contact/terminal members 24,26,28 and the plug contacts. The contact portions 24*a*,26*a*,28*a* are substantially parallel to one another and extend obliquely through receptacle 14 between relatively lower positions proximate to the entrance opening and relatively upper positions closer to the rear of the receptacle 14. In the present context, it is understood that the term "substantially parallel" is broad enough to cover a construction in which the contact portions 24*a*,26*a*,28*a* define a small angle between them of from 0° to about 10°.

As noted above, the contact/terminal members 24,26,28 are geometrically different from one another and arranged in conjunction with the insert housing 30 in order to provide that each contact/terminal member in the connector assembly 10 has a different geometry than any adjacent contact/terminal member(s). To this end, contact/terminal members 26 are formed so that free edges 26' of contact portions 26*a* are situated near and face toward the closed, rear end of the receptacle 14 and thus contact portions 26*a* of contact/terminal members 26 are designated "rearward facing contact portions". Similarly, contact/terminal members 28 are formed so that free edges 28' of contact portions 28*a* are situated near and face toward the closed, rear end of the receptacle 14 and thus contact portions 28*a* of contact/terminal members 28 are also rearward facing contact portions. Contact/terminal members 24 are formed so that free edges 24' of contact portions 24*a* are situated near and face forward toward an entrance opening of receptacle 14 and thus contact portions 24*a* of contact/terminal members 24 are designated "forward facing contact portions". Hence, this is the reason for the designation of contact/terminal members 24 by "F" and contact/terminal members 26,28 by "R1" and "R2", respectively, as mentioned above. Thus, the contact/terminal members 24 are inherently different from the contact/terminal members 26,28 in view of the fact that the contact/terminal members 24 have a forward facing contact portion 24*a* whereas the contact/terminal members 26,28 have a rearward facing contact portion 26*a*,28*a*, and the contact/terminal members 26 are geometrically different from rearward facing contact/terminal members 28, for example as described below.

In addition to the arrangement of contact/terminal members 24,26,28 so that each contact/terminal member is different from any adjacent contact/terminal member(s), the use of contact/terminal members 24 having forward facing contact portions 24*a* among contact/terminal members 26,28 having rearward facing contact portions 26*a*,28*a*, respectively, has been found to maximize isolation of near-end crosstalk when connector assembly 10 is coupled to a modular plug whose contact blades are assigned to terminate a cable wire according to ANSI/EIA/TIA standard 568B (see the discussion of the reduction in crosstalk arising from different contact/terminal members in the '941 and '266 patents referenced above). It is also important to note that the axis of the loop current flowing through each contact/terminal member pair including a forward facing contact/terminal member and a rearward facing contact/terminal member is tilted or skewed thereby reducing magnetic field coupling between signal pairs relative to the case where the contact/terminal members were identically configured.

As discussed in the '941 and '266 patents, it has been found that with the particular positional arrangement of two contact/terminal members 24 having a forward facing contact portion 24*a* and a total of six contact/terminal members 26,28 having a rearward facing contact portion 26*a*,28*a*, respectively, in the pattern described above (R2,R12,F,R1, F,R1,R2,R1) optimum isolation for source/victim twisted wire pairs "1" and "3" (which generally generate the greatest NEXT) is achieved when coupled to an eight position modular plug whose contacts are assigned to terminate 4 twisted wire pair cable according to ANSI EIA/TIA standard 568B. This is accomplished without introducing additional NEXT failures associated with the contact/terminal members at positions P4–P5 (wire pair "1") and the contact/terminal members at positions P1–P2 (wire pair "2") or P7–P8 (wire pair "4").

The arrangement of the contact/terminal members 24,26, 28 as described above in order to provide for a particular arrangement of forward facing contact portions and rearward facing contact portions, namely R2,R1,F,R1,F,R1,R2, R1, will essentially compensate for a split twisted pair where the normal pairing is split up and the individual wires are paired with wires from another pair. However, the invention is not limited to such an arrangement, and alternate wiring configurations will dictate notating contact/terminal members having forward and rearward facing contact portions for optimum crosstalk reduction effects. For example, other arrangements of forward and rearward facing contact/terminal members in a connector in accordance with the invention include R1,F,R1,F,R2,R1,R2 and F,R1,F,R1,R2, R1,R2,R1.

Figure 3:
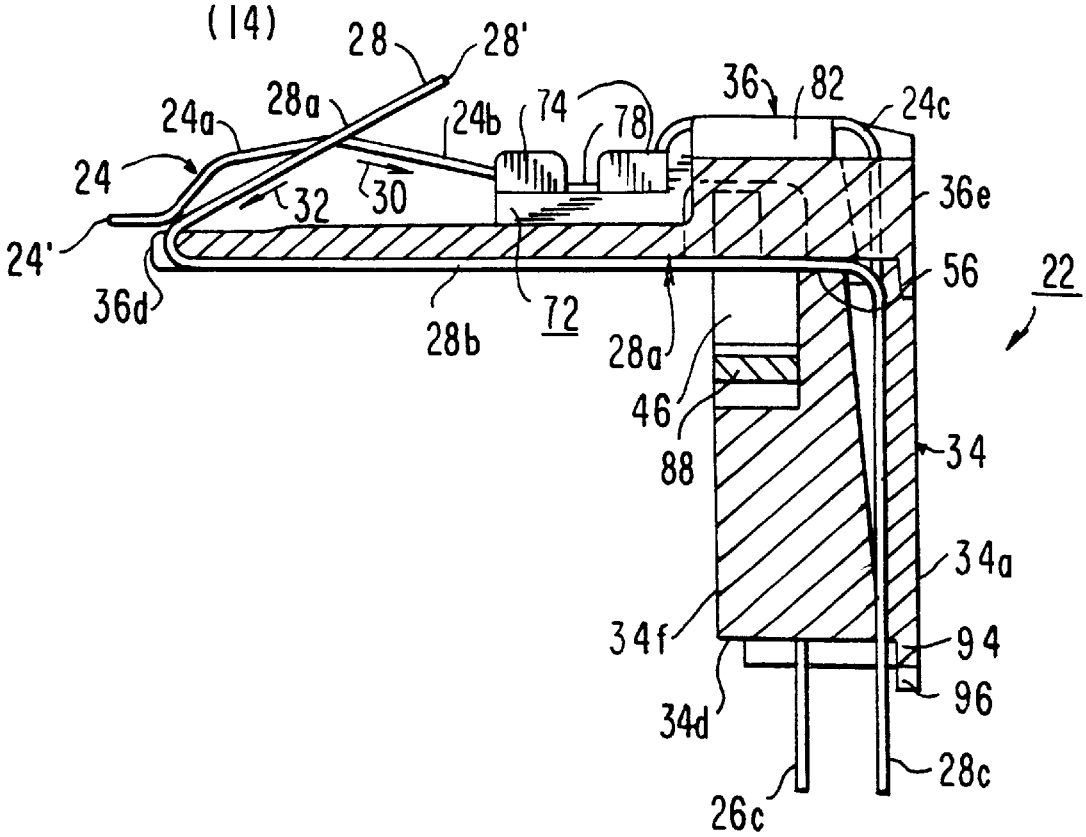
FIG. 3 shows a view of the insert assembly for a connector assembly in accordance with the invention taken along the line 3—3 in FIG. 2.
Figure 5:
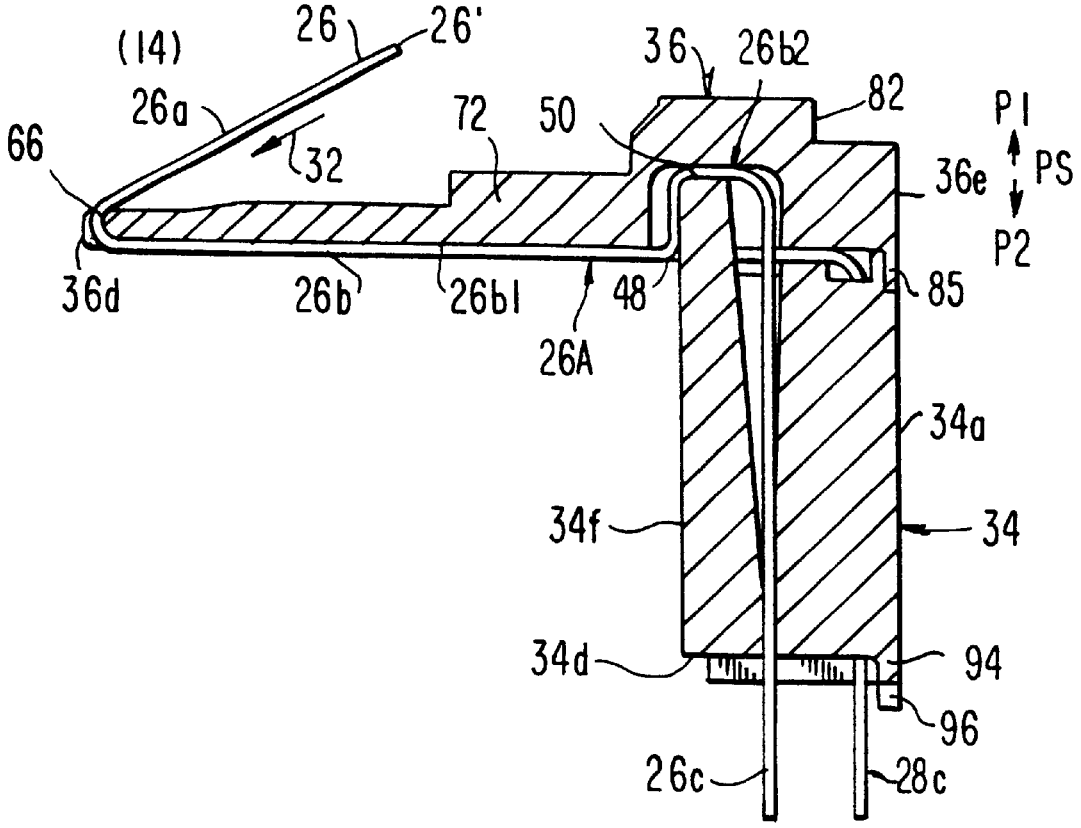
FIG. 5 shows a view of the insert assembly for a connector assembly in accordance with the invention taken along the line 5—5 in FIG. 2.

Referring now to FIG. 5, with respect to the difference in the geometric form of the contact/terminal members 26,28, contact/terminal members 26 are each configured to form the contact portion 26*a*, an associated pin-like terminal portion 26*c* and an intermediate conductor or bridging portion 26*b* extending between the contact portion 26*a* and the terminal portion 26*c*. Each conductor portion 26*b* includes an elongate portion 26*b*1 adjacent the respective contact portion 26*a* and an inverted U-shaped or step portion 26*b*2 adjacent the respective terminal portion 26*c*. Referring to FIG. 3, contact/terminal members 28 are each configured to form the contact portion 28*a*, an associated pin-like terminal portion 28*c* and a substantially linear intermediate conductor portion 28*b* extending between the contact portion 28*a* and the terminal portion 28*c*.

The construction of the contact/terminal members 26 thus differs from the construction of the contact/terminal members 28 primarily in view of the inverted U-shaped portion 26*b*2 of the intermediate portion of the contact/terminal members 26 (see FIG. 5). By contrast, the intermediate portion 28*b* of the contact/terminal members 28 is essentially straight between the contact portion 28*a* and the terminal portion 28*c* (see FIG. 3). Thus, portions of the inverted U-shaped portion 26*b*2 of the contact/terminal members 26 are arranged in a common plane P1 which is generally parallel and in opposed relationship to and spaced from a plane P2 in which the intermediate conductor portions 28*b* of the contact/terminal members 28 are arranged. These planes P1,P2 are separated by a distance designated PS. This difference in geometric construction of contact/terminal members 26,28, and specifically, the separation between the intermediate conductor portion 28*b* and the opposed portion of the inverted U-shaped portion 26*b*2, contributes to the reduction in near-end crosstalk between the contact/terminal members 26,28. It is understood that although an inverted U-shaped step is shown in contact/terminal members 26, other forms whereby a portion of the contact/terminal member 26 or 28 is displaced from, but in opposed relationship to, the other contact/terminal member 28,26 may be applied in accordance with the invention.

Figure 4:
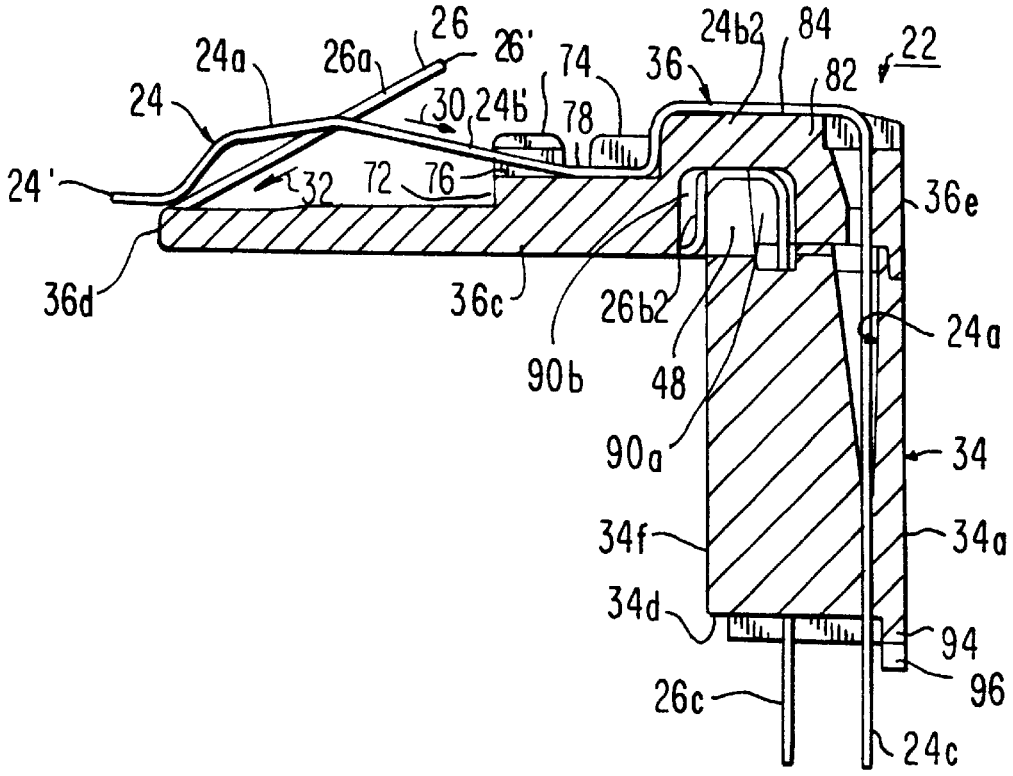
FIG. 4 shows a view of the insert assembly for a connector assembly in accordance with the invention taken along the line 4—4 in FIG. 2.

Referring now to FIG. 4, contact/terminal members 24 are each configured to form the forward facing contact portion 24*a*, an associated pin-like terminal portion 24*c* and an intermediate conductor portion 24*b* extending between the contact portion 24*a* and the terminal portion 24*c*. Each conductor portion 24*b* includes an inclined portion 24*b*1 adjacent the respective contact portion 24*a* and an inverted U-shaped portion 24*b*2 adjacent the respective terminal portion 24*c*.

To accommodate the three different forms of contact/terminal members 24,26,28, the insert housing 30 defines three different sets of conduits 24A,26A,28A (FIGS. 3–5). Conduits 24A each receive a respective contact/terminal member 24, conduits 26A each receive a respective contact/terminal member 26 and conduits 28A each receive a respective contact/terminal member 28. The construction of conduits 24A,26A,28A will be described below.

Figure 6:
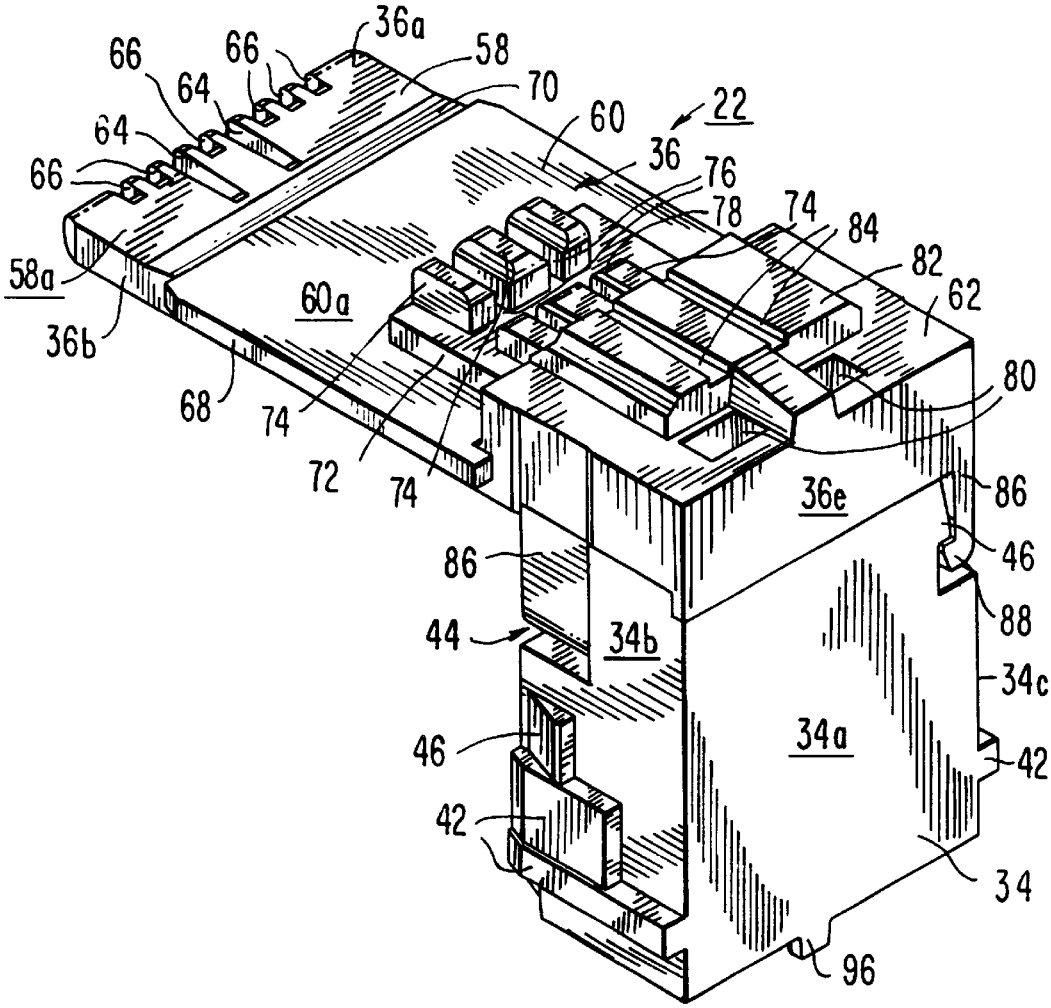
FIG. 6 shows a top perspective view of the insert housing of the insert assembly for a connector assembly in accordance with the invention.
Figure 7:
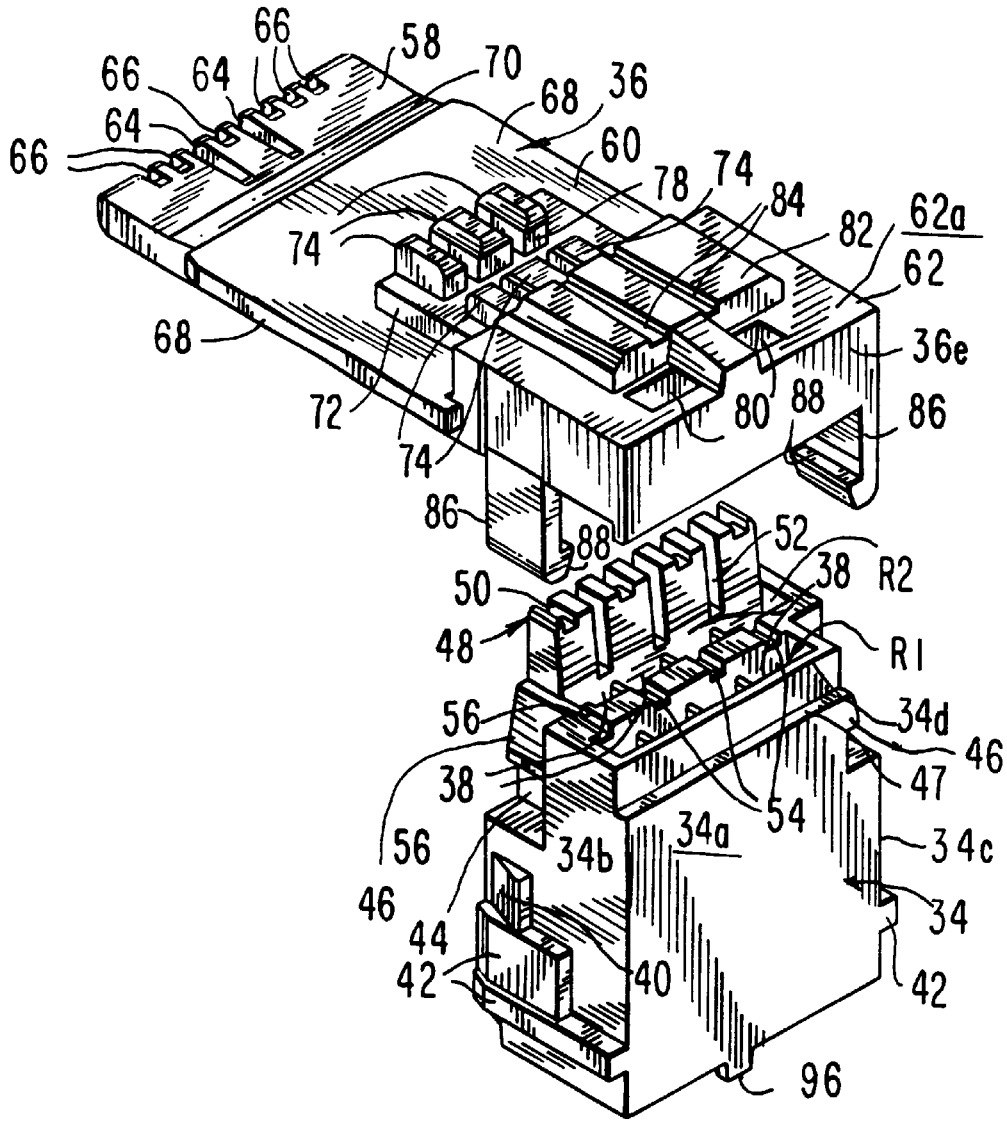
FIG. 7 shows a top exploded perspective view of the insert housing of the insert assembly for a connector assembly in accordance with the invention.

As shown most clearly in FIGS. 6 and 7, the insert housing 30 has a generally L-shaped configuration including two discrete parts, namely a lower base part 34 and an upper cap part 36, both made of a dielectric material. Once mated, the cap part 36 extends from the top of the base part 34 in a cantilever fashion. Two separate parts are preferred in order to enable easy assembly of the insert assembly 22.

The base part 34 has a substantially planar rear surface 34*a*, opposed side surfaces 34*b*, 34*c*, a top surface 34*d*, a bottom surface 34*e* and a substantially planar front surface 34*f*. A plurality of tapered, substantially parallel channels or bores 38 are formed in the base part 34 corresponding to the number of contact/terminal members 24,26,28 to be mounted in the connector assembly 10, eight in the illustrated embodiment which are arranged in two rows R1,R2 of four bores each. Bores 38 extend from the top surface 34*d* to the bottom surface 34*e*. Each pin-like terminal portion 24*c*, 26*c*, 28*c* of the contact/terminal members 24,26,28, respectively, is positioned in a respective bore 38 and has a length such that it projects out from the bottom of respective bore 38 for connection to a substrate such as a printed circuit board 8 (see FIG. 2). A locking shoulder 40 is formed on the side surfaces 34*b*, 34*c* of the base part 34 to facilitate locking engagement of the insert assembly 22 in the housing 12. Guide members 42 are arranged on each side surface 34*b*, 34*c* below the locking shoulder 40 to guide the insertion of the insert assembly 22 into the housing 12. Further, the side surfaces 34*b*, 34*c* each have a recessed portion 44 adjacent the upper surface 34*d* on which another locking shoulder or snap ramp 46 is arranged (FIG. 7). The snap ramps 46 are arranged to facilitate locking engagement of the base part 34 to the cap part 36. A narrow, inward step 47 is formed at the upper edge of the rear surface 34*a* and extends between the side surfaces 34*b*, 34*c*.

The base part 34 also includes a plurality of projections 48 extending from the upper surface 34*d* adjacent the front surface 34*f*. In particular, there are four projections 48, each defining a channel 50 in an upper surface thereof which is adapted to retain the inverted U-shaped portion 26*b*2 of a respective contact/terminal member 26. Furthermore, the projections 48 are spaced from one another to define channels 52 between each adjacent pair. Channels 52 are also adapted to retain a portion of a contact/terminal member, although in the illustrated embodiment, only one of the contact/terminal members 28 actually passes through a respective channel 52 defined between the third and fourth projections 48 (counting from the left) and thus only this channel is necessary in the illustrated embodiment. Channels 50 align substantially with the centers of the bores 38 in the front row R2 of bores 38 whereas channels 52 align substantially with the centers of the bores 38 in the rear row R1 of bores 38. To this end, the portion of the upper surface 34*d* of the base part 34 between the front and rear rows R2,R1 of bores 38 includes four channels 54. Each channel 54 in the upper surface 34*d* aligns with one of the channels 52, although only one channel 54 is used in the illustrated embodiment, i.e, that channel 54 aligning with the channel 52 defined between the third and fourth projections, and the intermediate conductor portion 28*b* of one of the contact/terminal members 28 is adapted to be retained in these aligning channels 52,54 (the contact/terminal member 28 at position P7). The upper surface 34*d* also includes a channel 56 extending alongside the first projection 48 adjacent the side surface 34*b* and aligning with the bore 38 in the rear row R1 of bores 38 proximate the side surface 34*b*. Channel 56 is also adapted to retain the intermediate conductor portion 28*b* of one of the contact/terminal members 28 (the contact/terminal member 28 at position P1).

The cap part 36 is elongate and has a front portion 58 which will be situated proximate the front face 15 of the housing 12, a middle portion 60 and a rear portion 62. The cap portions 58,60,62 have common side surfaces 36*a*,36*b* and a common bottom surface 36*c*. The front portion 58 defines a front surface 36d of the cap part 36 whereas the rear portion 62 defines a rear surface 36*e* of the cap part 36. The front portion 58 of cap part 36 has a top surface 58*a*, the middle portion 60 has a top surface 60*a* and the rear portion 62 has a top surface 62*a*. The cap part 36 has a tapering portion 70 between the top surface 58*a* of the front portion 58 and the top surface 60*a* of the middle portion 60.

The front surface 36*d* has a plurality of grooves or channels 64,66 formed therein. Channels 64, of which there are two, extend further into the front portion 58 of the cap part 36 than channels 66, of which there are six (FIG. 6). Channels 64 are formed at locations corresponding to contact positions P3 and P5, i.e., at the locations corresponding to the positions of contact/terminal members 24, so that the contact portions 24*a* of these contact/terminal members 24 may be depressed therein upon entry of the plug into the receptacle 14. Channels 66 are formed at locations corresponding to contact positions P1, P2, P4 and P6–P8, i.e., at the locations corresponding to the positions of contact/terminal members 26,28, and curve around between the upper and lower surfaces of the front portion 58 of the cap part 36. A longitudinal guide rib 68 is arranged on each side surface 36*a*,36*b* to aid in insertion of the insert assembly 22 into the housing 12.

The middle portion 60 of the cap part 36 has a raised platform 72 projecting from top surface 60*a* and having projections 74 arranged thereon. Projections 74 are spaced from one another to define two longitudinally-extending channels 76, each receivable of the inclined portion 24*b* of a respective one of the contact/terminal members 24, and a transverse channel 78 intersecting both longitudinal channels 76 to facilitate securing of the contact/terminal members 24 in the channels 76, e.g., by staking.

The rear portion 62 of the cap part 36 defines two channels or bores 80 extending through the cap part 36. Each bore 80 aligns with a respective bore 38 in the rear row R1 of bores formed in the base part 34, specifically, the two middle bores in the rear row R1. Further, the rear portion 62 has a raised guide member 82 arranged on the top surface 62*a* and which defines two longitudinal channels 84. Each longitudinal channel 84 aligns with a respective longitudinal channel 76 defined by the projections 74. A ridge 85 projects downward from the rear surface 36*e* and extends between the side surfaces 36*b*,36*c*. Ridge 85 is adapted to fit in recess 47 on the base part 34.

The rear portion 62 of the cap part 36 also includes latch arms 86 projecting from the bottom surface 36*c* on the sides of the cap part 36. The latch arms 86 are arranged to cooperate and mate with a respective snap ramp 46 on the base part 34 to ensure a secure coupling of the base part 34 and cap part 36. Each latch arm 86 has a projection 88 at an end thereof which is adapted to abut against a raised edge of the respective snap ramp 46 and prevent unintentional separation of the latch arm 86 from the snap ramp 46 and thus unintentional separation of the cap part 36 from the base part 34. The latch arms 86 are situated on opposite sides of the rear portion 62, i.e., one latch arm 86 extends adjacent the rear surface 36*e* of the cap part 36 and the other latch arm 86 extends from a middle region of the rear portion 62 and is not adjacent the rear surface 36*e*. The snap ramps 46 are thus arranged on the base part 34 in a corresponding manner. Other appropriate cooperative coupling means for coupling the base part 34 to the cap part 36 may also be applied in the invention without deviating from the scope and spirit thereof.

Figure 8:
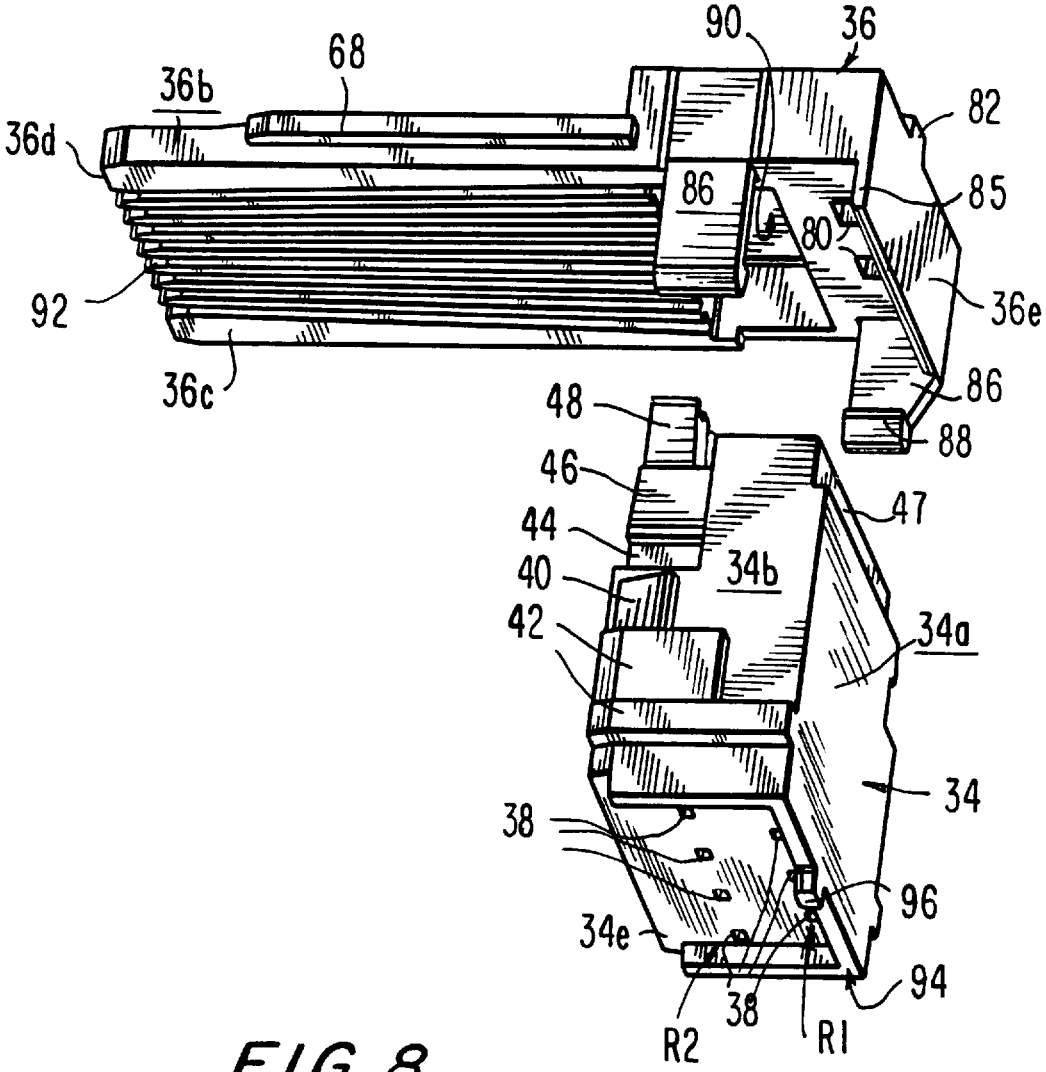
FIG. 8 shows a bottom exploded perspective view of the insert housing of the insert assembly for a connector assembly in accordance with the invention.
Figure 9:
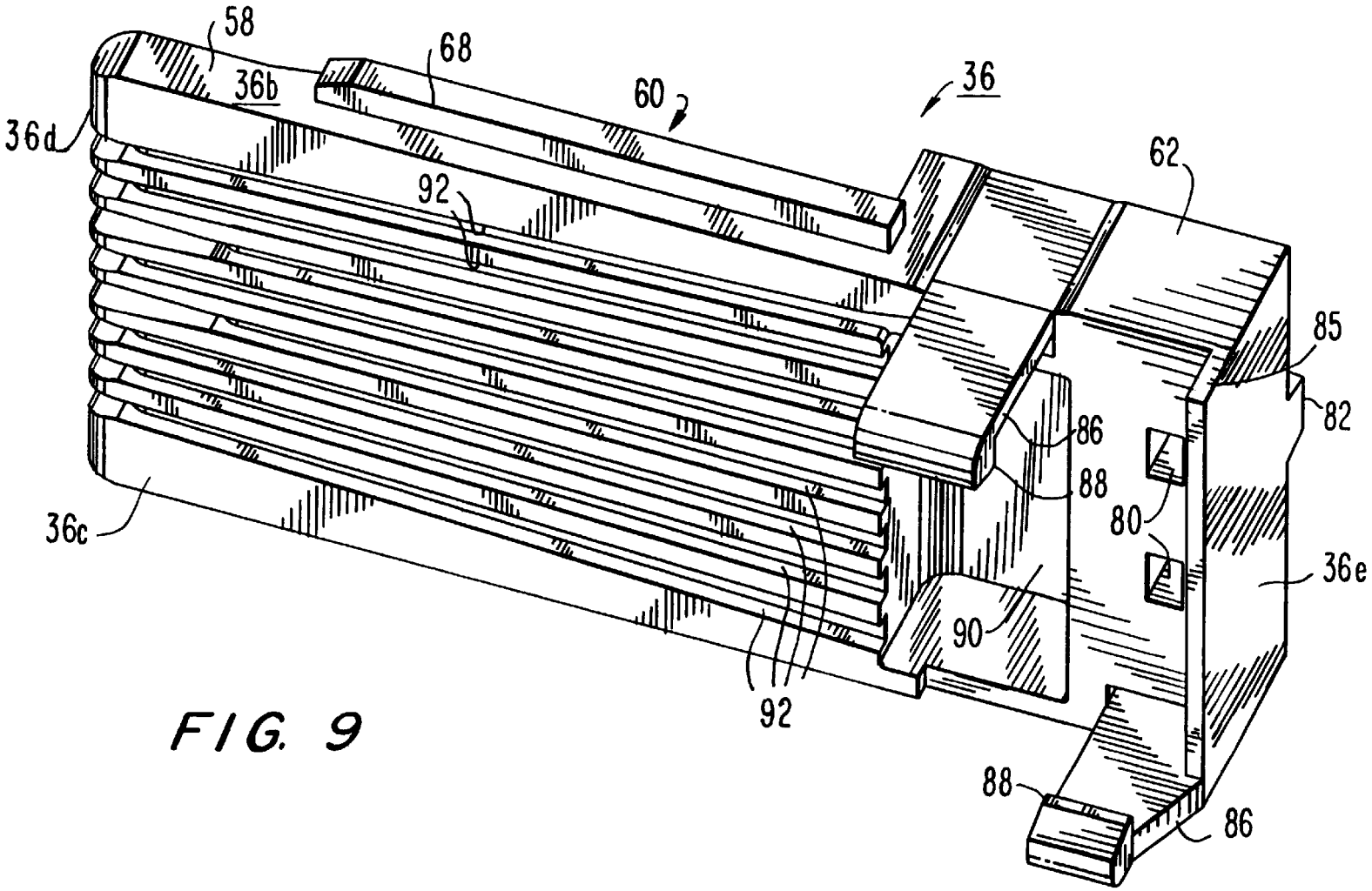
FIG. 9 shows a bottom perspective view of a cap part of the insert housing of the insert assembly for a connector assembly in accordance with the invention.

Referring now to FIGS. 8 and 9, the cap part 36 includes a recess 90 in the bottom surface 36*c* and a plurality of longitudinally channels 92. Recess 90 is sized to receive the projections 48 of the base part 34. Each channel 92 is adapted to receive a respective contact/terminal member 26,28 and aligns with one of the channels 64,66 in the front surface 36*d* of the cap part 36.

The base part 34 has a ridge 94 extending downward from the rear surface 34*a* and side surfaces 34*b*, 34*c* and a stand-off post 96 arranged on the portion of the ridge 94 extending downward from the rear surface 34*a* to stabilize and position the connector assembly 10 on the printed circuit board to which it is mounted.

Each conduit 24A thus comprises a bore 38 in the rear row R1 of bores 38 in the base part 34, an aligning bore 80 in the cap part 36, an aligning channel 84 in the guide member 82, an aligning channel 76 defined by projections 74 and an aligning channel 64. Each conduit 26A comprises a bore 38 in the front row R2 of bores 38 in the base part 34, a first passage 90*a* defined in recess 90 situated between the projections 48 and a rear portion of the periphery of the recess 90 (FIG. 4), an aligning channel 50 formed in a projection 48, a second passage 90*b* defining recess 90 situated between the projections 48 and a front portion of the periphery of the recess 90, an aligning channel 92 and an aligning channel 66. Conduits 28A each comprise a bore 38 in the rear row R1 of bores 38 in the base part 34, the channel 56 or channels 52 and 54, an aligning channel 92 and an aligning channel 66.

Figure 10A:
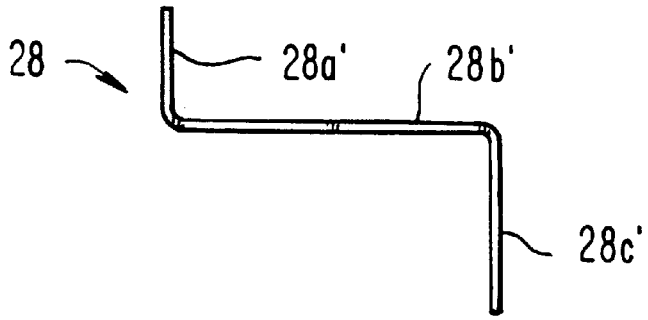
FIG. 10A shows a first type of contact/terminal member used in the insert assembly for a connector assembly in accordance with the invention in its pre-assembled form.
Figure 10B:
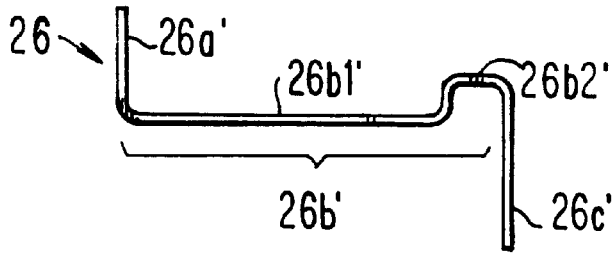
FIG. 10B shows a second type of contact/terminal member used in the insert assembly for a connector assembly in accordance with the invention in its pre-assembled form.
Figure 10C:
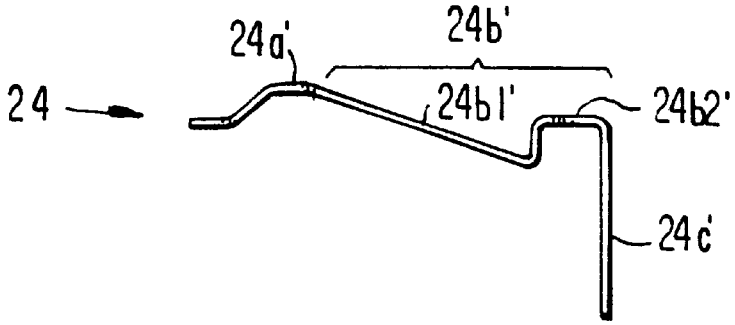
FIG. 10C shows a third type of contact/terminal member used in the insert assembly for a connector assembly in accordance with the invention in its pre-assembled form.
Figure 11:
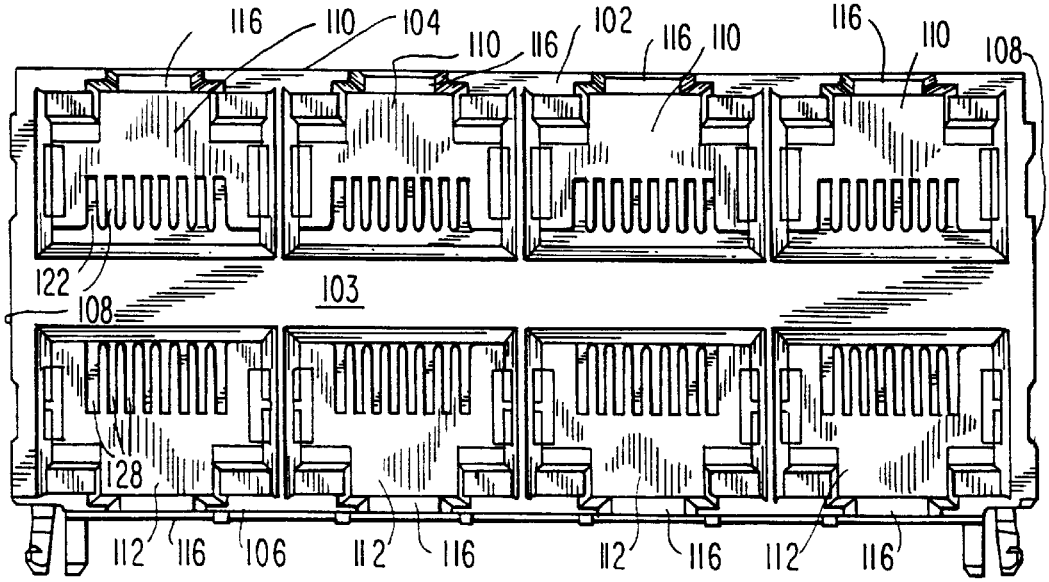
FIG. 11 shows a front view of an outer housing part of a bi-level multi-port connector assembly in which the insert assembly for a connector assembly in accordance with the invention is placed.
Figure 12:
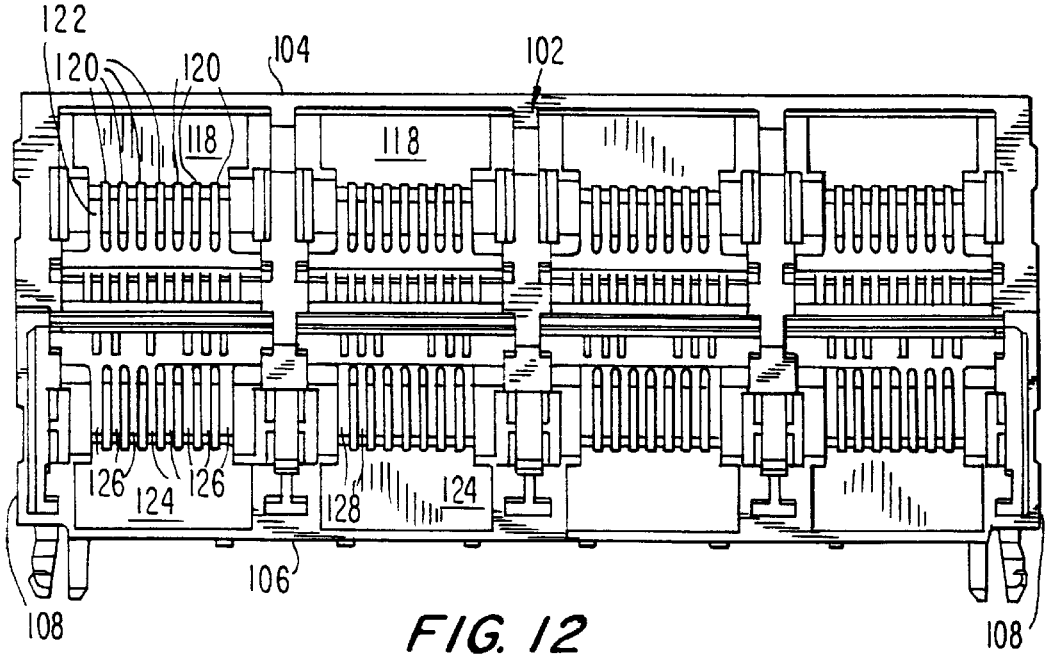
FIG. 12 shows a rear view of the outer housing part of FIG. 11.
Figure 13:
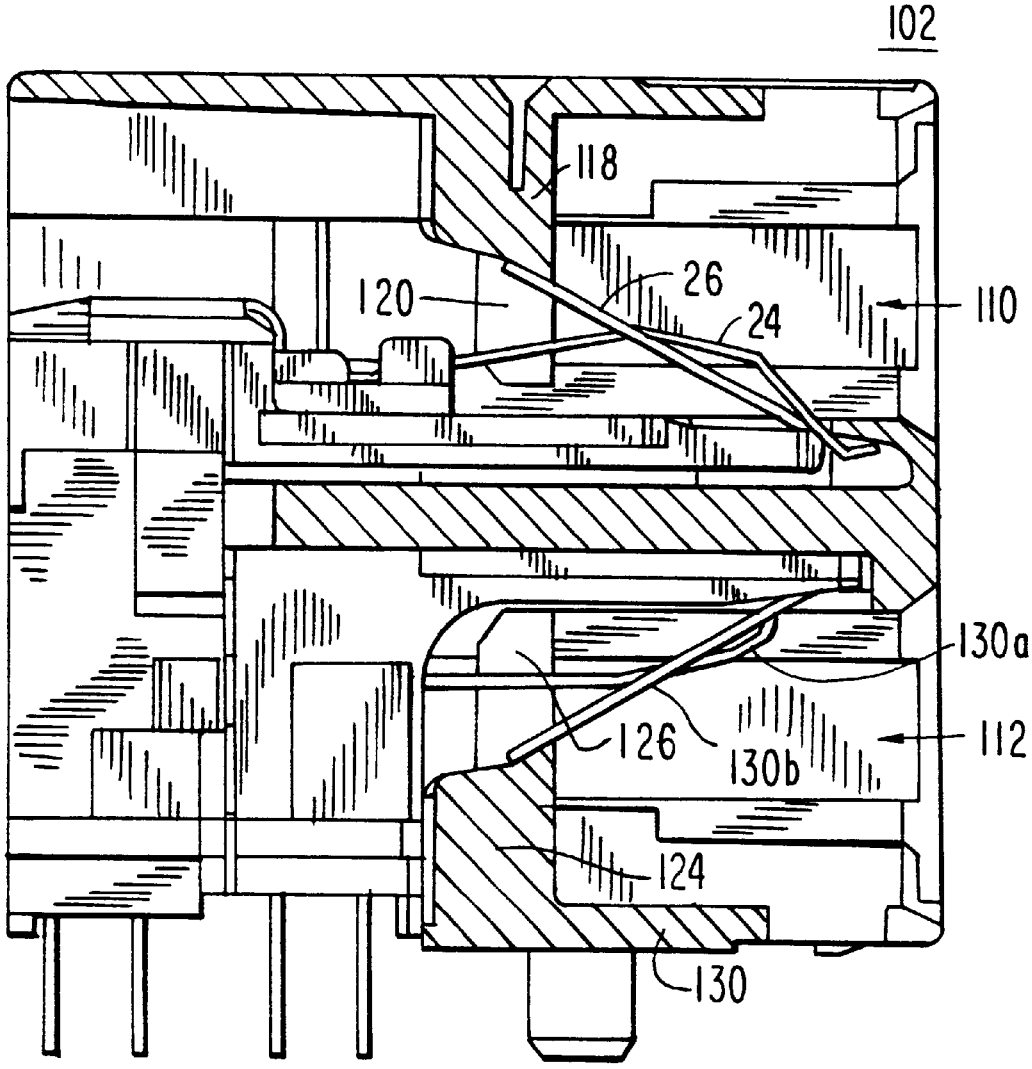
FIG. 13 shows a cross-section through a connector assembly in accordance with the invention including the outer housing part shown in FIG. 11, the insert assembly shown in FIGS. 2–5 and a lower insert assembly.

FIGS. 10A, 10B and 10C show the contact/terminal members 24,26,28 in their pre-assembled state, i.e., prior to assembly of the connector assembly 10 in the manner described below. In this state, each contact/terminal member 28 has an elongate contact portion 28*a*', an elongate intermediate conductor portion 28*b*' arranged perpendicular to and at an end of the contact portion 28*a*' and an elongate terminal portion 28*c*' extending perpendicularly from one end of the intermediate conductor portion 28*b*' (FIG. 10A). Each contact/terminal member 26 has an elongate contact portion 26*a*', an elongate intermediate conductor portion 26*b*1' arranged perpendicular to and at an end of the contact portion 26*a*', an inverted U-shaped portion 26*b*2' and a terminal portion 26*c*' extending downward from the inverted U-shaped portion 26*b*2' (FIG. 10B). Each contact/terminal member 24 has a forwardly inclined portion 24*a*', a rearward inclined conductor portion 24*b*1' arranged at the rearward end of the forwardly inclined portion 24*a*', an inverted U-shaped portion 24*b*2' arranged at the rearward end of the rearward inclined portion 24*b*1' and a terminal portion 24*c*' extending downward from the inverted U-shaped portion 24*b*2'.

To assemble the insert assembly 22, base part 34 and cap part 36 are formed, e.g., by molding, and contact/terminal members 26,28 are stamped and provided with the form shown in FIGS. 10A and 10B, respectively. The contact/terminal members 26,28 are then mounted on the base part 34. Specifically, one contact/terminal member 26 is inserted into each bore 38 in the front row R2 of bores in the base part 34 so that the terminal portion 26*c*' is situated within the respective bore 38 and a portion extends beyond the bottom surface 34*d* of the base part 34 and the inverted U-shaped portion 26*b*2' is positioned within the channel 50 in a respective one of the projections 48 (see FIG. 5). One contact/terminal member 28 is inserted into the first bore 38 (from the left) in the rear row R1 of bores 38 in the base part 34 so that the terminal portion 28*c*' is situated within the bore 38 and a portion extends beyond the bottom surface 34*d* of the base part 34 and the intermediate conductor portion 28*b*' is positioned within the channel 56 (see FIG. 3). Another contact/terminal member 28 is inserted into the last bore 38 in the rear row R1 of bores in the base part 36 so that the terminal portion 28*c*' is situated within the bore 38 and a portion extends beyond the bottom surface 34*d* of the base part 34 and the intermediate conductor portion 28*b*' is positioned within the channel 52 defined between a pair of projections 48.

The cap part 36 is then snapped onto the base part 34 by means of the locking engagement of the projections 88 on the latch arms 86 of the cap part 36 to the snap ramps 46 of the base part 34, resulting in a snug fit of the ridge 85 of the cap part 36 in the recess 47 on the base part 34. The snug fit of the ridge 85 in recess 47 provides stability to the insert 22 and protection for the contact/terminal members 24,26,28. The contact/terminal members 26 are thus secured between the surface of the cap part 36 defining the recess 90 and the channels 50 (FIG. 5) and the contact/terminal members 28 are secured by the horizontal joint between the base part 34 and the cap part 36 (FIG. 3). Further, the intermediate conductor portion 26*b*' of each contact/terminal members 26 and the intermediate conductor portion 28*b*1' of each contact/terminal members 28 are positioned within a respective one of the channels 92 in the bottom surface of the cap part 36 and the terminal portions 26*a*' and 28*a*' of the contact/terminal members 26,28 extend through the channels 66 in the front surface of the cap part 36.

After the cap part 36 is secured to the base part 34, a contact/terminal member 24 is inserted into each bore 80 so that the terminal portion 24*c*' is situated within the bore 80 and within the aligned bore 38 in the base part 34, and a portion thereof extends beyond the bottom surface 34*d* of the base part 34. The inverted U-shaped portion 24*b*2 ' of each contact/terminal member 24 is positioned within the respective channel 84 in the guide member 82 and the inclined conductor portion 24*b*1' is positioned within the respective channel 76 defined by the projections 74 on platform 72. The contact/terminal members 24 are secured to the cap part 36 by staking in the region of the transverse channel 78 defined by the projections 74.

The insert assembly 22 is then ready to be inserted into the housing 12. This insertion is guided by guide members 42 and longitudinal guide rib 68 which are received in corresponding channels (not shown) formed in the housing 12. Thereafter, the locking shoulder 40 snaps into engagement with a corresponding shoulder (not shown) formed in the housing 12 to lock the insert 22 to the housing 12.

The housing 12 may be attached to the printed circuit board 8 in a number of conventional ways, including providing a mounting post on the housing 12 for coupling to the printed circuit board, providing a solder tail on a shield which can surround the housing 12 and be coupled to the printed circuit board or providing the housing 12 with one or more slots and solder tails situated in the slots and which are coupled to the printed circuit board 8. The placement of the connector assembly 10 on the printed circuit board 8 is aided by the contact of the stand-off post 96 with the printed circuit board 8. The terminal portions 24*c*, 26*c*, 28*c* are electrically coupled to pads on the printed circuit board 8. The connector assembly 10 is thereafter ready to receive a plug in the receptacle 14 and electrically couple the contacts in the plug to the printed circuit board 8 with a substantial reduction in the amount of crosstalk which would normally be generated by coupling a plug to a printed circuit board through a conventional modular jack connector.

The insert assembly 22 can be used in any type of jack housing, including an RJ-style jack housing. In one particular embodiment, the insert assembly 22 is used in a multi-level multi-port jack housing having receptacles in at least two levels whereby the receptacles are either in line with one another (i.e., in vertical columns) or offset from one another.

FIGS. 11–14 show a bi-level multi-port connector assembly generally designated as 100 including an outer housing 102 having a front face 103, a top face 104, a bottom face 106 and side faces 108. Housing 102 is open at its rear. The connector assembly 100 includes upper plug-receiving receptacles 110 and lower plug-receiving receptacles 112. Each upper receptacle 110 is configured to receive a respective insert assembly 22 and each lower receptacle 112 is configured to receive a respective lower insert assembly 114. To this end, each receptacle 110, 112 includes a latching member 116 so that when a plug is inserted into each receptacle 110,112, the latch of each plug engages the respective latching member 116. Each upper receptacle 110 includes an interior wall 118 having a plurality of longitudinally spaced partitions 120 extending downwardly therefrom which define slots 122 for receiving its respective contact/terminal members 24,26,28 of the insert assembly 22. Each lower receptacle 112 includes an interior wall 124 having a plurality of longitudinally spaced partitions 126 extending upwardly therefrom which define slots 128 for receiving contact/terminal members 130 of the lower insert assembly 114.

Lower insert assembly 114 may be of the type disclosed in U.S. provisional patent application Serial No. 60/089,513 filed Jun. 16, 1998 and incorporated herein by reference. Briefly, lower insert assembly 114 includes a generally L-shaped dielectric housing 132 and two different contact/terminal members 130*a*,130*b*. Contact/terminal members 130*a* have a forward facing contact portion, i.e., the free edge of the contact portion faces the front of the housing 132 (as well as the rear of the connector assembly 100), and contact/terminal members have a rearward facing contact portion, i.e., the free edge of the contact portion faces the rear of the housing 132 (as well as the rear of the connector assembly 100).

Figure 14:
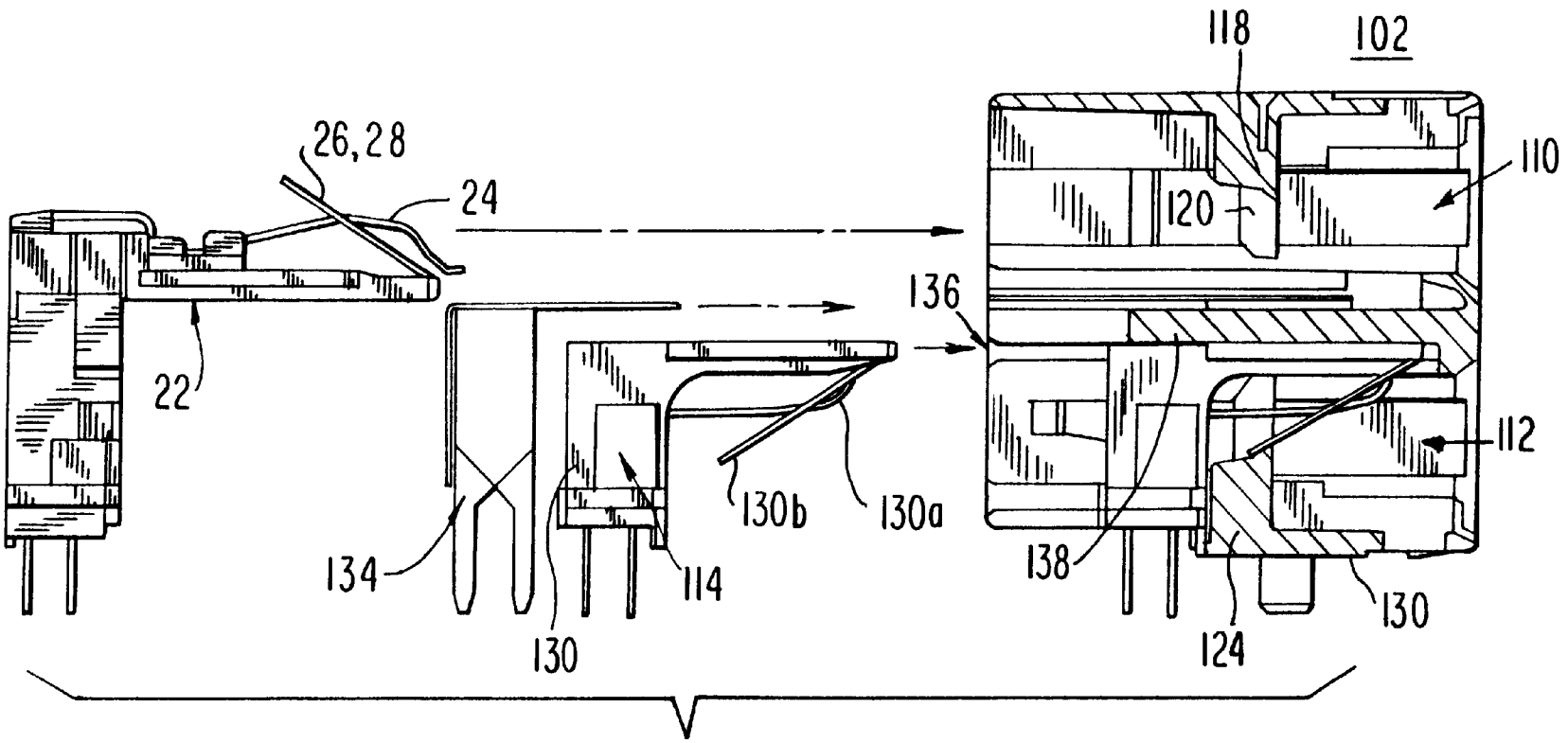
FIG. 14 shows an assembly view of the connector assembly shown in FIG. 13.

As shown in FIG. 14, connector assembly 100 may include an optional shield 134 situated between the lower insert assemblies 114 in the lower receptacles 112 and the insert assemblies 22 in the upper receptacles 110. Shield 134 fits into a slot 136 formed above a transverse wall 138 of the housing 102.

To assemble connector assembly 100, an insert assembly 114 is inserted into each lower receptacle 112, the shield 134 is then slid into the slot 136 and finally an upper insert assembly 22 is inserted into each upper receptacle 110. The connector assembly 100 may be surrounded by a shield and the housing 102 and/or shield 134 may include means for attaching the connector assembly 100 to a substrate such as a printed circuit board.

With respect to the offset configuration, a multi-level connector assembly in which the insert assembly 22 described above may be used is disclosed in U.S. patent application Ser. No. 09/169,627 filed Oct. 9, 1998, incorporated herein by reference.

Obviously, numerous modifications and variations of the present invention are possible in light of the above teachings. The invention may be applied in connectors other than of a type adapted for use with cables whose wires are assigned to contact/terminal members in a manner other than as specified by EIA/TIA standard 568B of ANSI. For example, the arrangement of contact/terminal members having forward and rearward facing contact portions in the connector insert may vary from that shown and described. Connectors in accordance with the invention may be other than of a type adapted for connection to printed circuit boards, and other configurations of contact/terminal members are possible in accordance with the invention. Also, although in a preferred embodiments, each contact/terminal member is geometrically different than any immediately adjacent contact/terminal members, it is possible that adjacent contact/terminal members could have the same geometry if it is found that providing the contact/terminal members with different geometrical configurations does not meaningfully contribute to a reduction in crosstalk (although if an 8-position insert assembly is used, this would entail modifications to, e.g., the insert housing described above). Accordingly, it is understood that other embodiments of the invention are possible in the light of the above teachings.

We claim:

1. A modular electrical connector assembly, comprising:

a receptacle housing having at least one plug-receiving receptacle, and at least one insert assembly arranged in said receptacle housing and comprising:

an L-shaped insert housing having a bottom surface and a top surface, said receptacle being defined above said top surface, said insert housing comprising a base part having top and bottom surfaces, front and rear surfaces and opposed lateral surfaces, and a cap part having top and bottom surfaces, front and rear surfaces and opposed lateral surfaces, said bottom surface of said cap part partially overlying said top surface of said base part such that said cap part extends in a cantilever fashion from said base part, a first set of contact/terminal members each including a contact portion situated in said receptacle, a terminal portion extending beyond said bottom surface of said insert housing and an intermediate portion interconnecting said contact portion and said terminal portion, a second set of contact/terminal members each including a contact portion situated in said receptacle, a terminal portion extending beyond said bottom surface of said insert housing and an intermediate portion interconnecting said contact portion and said terminal portion, said contact/terminal members in said first set being parallel to and geometrically different than said contact/terminal members in said second set, and said insert housing defining a first set of conduits receiving said contact/terminal members in said first set of contact/terminal members and a second set of conduits receiving said contact/terminal members in said second set of contact/terminal members, said first and second sets of conduits being defined such that adjacent ones of said contact/terminal members received in said first and second sets of conduits are geometrically different from one another, each of said conduits in said first set of conduits comprising a bore arranged in said base part and extending between said top and bottom surfaces of said base part, a channel arranged on said bottom surface of said cap part and extending from proximate said base part to adjacent said front surface of said cap part, and a groove arranged in said front surface of said cap part and aligning with said channel;

a respective one of said contact/terminal members in said first set of contact/terminal members extending through said bore in said base part, through said channel on said cap part and through said groove in said front surface of said cap part into said receptacle and then in said receptacle toward a rear of said receptacle housing to thereby provide a rearward facing contact portion;

each of said conduits in said second set of conduits comprising a first bore arranged in said base part and extending between said top and bottom surfaces of said base part, and a second bore arranged in said cap part and extending between said top and bottom surfaces of said cap part, said second bore aligning with said first bore in said base part;

a respective one of said contact/terminal members in said second set of contact/terminal members extending through said first bore in said base part, through said second bore in said cap part into said receptacle and then in said receptacle toward a front of said receptacle housing to thereby provide a forward facing contact portion.

2. The connector assembly of claim 1, wherein said cap part further comprises retaining means arranged on said top surface of said cap part for retaining said contact/terminal members in said third set of contact/terminal members.

3. The connector assembly of claim 2, wherein said retaining means comprise a plurality of projections arranged on said top surface, said projections defining at least one groove receivable of a respective one of said second set of contact/terminal members.

4. The connector assembly of claim 1, further comprising a third set of contact/terminal members, each of said contact/terminal members in said third set including a contact portion extending into said receptacle, a terminal portion extending beyond said bottom surface of said insert housing and an intermediate portion interconnecting said contact portion and said terminal portion, said intermediate portion of said contact/terminal members in said third set being different than said intermediate portion of said contact/terminal members in said first and second sets, said insert housing defining a third set of conduits receiving said contact/terminal members in said third set of contact/terminal members, said conduits in said third set being different than said conduits in said first and second sets, said first, second and third sets of conduits being arranged in said insert housing such that adjacent ones of said contact/terminal members are different from one another, said base part including at least one projection extending outward from said top surface, said cap part having a recess for receiving said at least one projection, each of said conduits in said third set of conduits comprising a bore arranged in said base part and extending between said top and bottom surfaces of said base part, and a groove arranged in said front surface of said cap part and aligning with said bore, a respective one of said contact/terminal members in said third set of contact/terminal members extending through said bore in said base part, over a respective one of said at least one projection, through said channel in said cap part and through said groove in said front surface of said cap part into said receptacle and then in said receptacle toward a rear of said receptacle housing to thereby constitute a rearward facing contact/terminal member.

5. The connector assembly of claim 4, wherein each of said conduits in said third set of conduits further comprises a groove arranged in a top face of a respective one of said at least one projection, each of said third set of contact/terminal members being arranged to pass through said groove in a respective one of said at least one projection such that said contact/terminal members passes along the respective projection in a first direction, into and through said groove in the respective projection, along the respective projection in a second direction opposite to the first direction and then through the aligning one of said channels on said bottom surface of said base part.

6. The connector assembly of claim 4, wherein said at least one projection on said base part comprises a plurality of projections spaced apart from one another to define channels between each adjacent pair of said projections, at least one of said first set of contact/terminal members extending through a respective one of said channels between a pair of said projections.

7. The connector assembly of claim 1, wherein said bores in said base part are arranged in first and second rows, each of said first set of contact/terminal members extending through a respective one of said bores in said first row of bores in said base part, each of said second set of contact/terminal members extending through a respective one of said bores in said second row of bores in said base part.

8. The connector assembly of claim 1, further comprising coupling means for coupling said base part to said cap part.

9. The connector assembly of claim 1, wherein said coupling means comprise a snap ramp arranged on each of said side surfaces of said base part and a latch arm arranged on each of said side surfaces of said cap part in alignment with a respective one of snap ramps.

10. The connector assembly of claim 1, wherein said base part comprises guide means for guiding insertion of said insert assembly into said receptacle housing and locking means for locking said insert assembly in said receptacle housing.

11. The connector assembly of claim 1, wherein said cap part has a ridge contiguous with said rear surface and said base part has a cooperative recess in said rear surface, said ridge being receivable within said recess.

12. The connector assembly of claim 1, wherein said contact portion of each of said first set of contact/terminal members is inclined and has a free edge facing a rear of said receptacle housing.

13. The connector assembly of claim 12, wherein said contact portion of each of said second set of contact/terminal members is inclined and has a free edge facing a front of said receptacle housing.

14. The connector assembly of claim 1, wherein said intermediate portion of each of said contact/terminal members in said first set is straight and said intermediate portion of each of said contact/terminal members in said second set includes an inverted U-shaped portion such that at least a portion of the conductor portion of each of said contact/terminal members in said second set is spaced from said intermediate portion of each of said contact/terminal members in said first set.

15. The connector assembly of claim 1, wherein said intermediate portions of said contact/terminal members in said first set are situated in a first plane and said intermediate portions of said contact/terminal members in said second set are partially situated in a second plane spaced from and parallel to said first plane.

16. The connector assembly of claim 1, wherein said contact portions of said contact/terminal members in said first and second sets extend obliquely through said receptacle between a lower position proximate an entrance opening of said receptacle and an upper position closer to a rear of said receptacle.

17. The connector assembly of claim 1, further comprising a third set of contact/terminal members each including a contact portion situated in said receptacle, a terminal portion extending beyond said bottom surface of said insert housing and an intermediate portion interconnecting said contact portion and said terminal portion, said intermediate portion of said contact/terminal members in said third set being different than said intermediate portion of said contact/terminal members in said first and second sets, said insert housing defining a third set of conduits receiving said contact/terminal members in said third set of contact/terminal members, said conduits in said third set being different than said conduits in said first and second sets, said first, second and third sets of conduits being arranged in said insert housing such that adjacent ones of said contact/terminal members received in said first, second and third sets of conduits are geometrically different from one another.

18. The connector assembly of claim 17, wherein the connector assembly is an eight position, eight contact jack wherein the positions are designated 1–8 in sequence, said first set of contact/terminal members comprising two contact/terminal members designated R1, said contact portion of each of said first set of contact/terminal members being inclined and having a free edge facing a rear of said receptacle housing, said second set of contact/terminal members comprising four contact/terminal members designated R2, said contact portion of each of said second of contact/terminal members being inclined and having a free edge facing a rear of said receptacle housing, said third set of contact/terminal members comprising two contact/terminal members designated F, said contact portion of each of said third set of contact/terminal members is inclined and has a free edge facing a front of said receptacle housing.

19. The connector assembly of claim 18, wherein said contact/terminal members of said first, second and third sets of contact/terminal members are arranged at positions 1–8 as follows: R2,R1,F,R1,F,R1,R2,R1.

20. The connector assembly of claim 18, wherein said contact/terminal members of said third set are arranged at positions 3 and 5.

21. The connector assembly of claim 1, wherein the connector assembly is a multi-level jack, said receptacle housing having a plurality of said plug-receiving receptacles arranged in upper and lower levels such that each of said upper and lower levels includes at least one of said receptacles, each of said receptacles being receivable of a respective plug, further comprising at least one lower insert assembly arranged in a respective one of said at least one receptacle in said lower level and including a plurality of contact/terminal members having contact portions situated in said respective receptacle, said at least one insert assembly being arranged in a respective one of said at least one receptacle in said upper level top thereby constitute an upper insert assembly and such that said contact portions of said first and second sets of contact/terminal members of said at least one insert assembly are situated in said respective receptacle.

22. The connector assembly of claim 21, wherein each of said at least one upper insert assembly further comprises a third set of contact/terminal members each including a contact portion extending into said respective receptacle in said upper level, a terminal portion extending beyond said bottom surface of said insert housing and an intermediate portion interconnecting said contact portion and said terminal portion, said intermediate portion of said contact/terminal members in said third set being different than said intermediate portion of said contact/terminal members in said first and second sets, said receptacle housing defining a third set of conduits for receiving said contact/terminal members in said third set of contact/terminal members, said conduits in said third set being different than said conduits in said first and second sets, said first, second and third sets of conduits being arranged in said insert housing such that adjacent ones of said contact/terminal members are geometrically different from one another.

23. The connector assembly of claim 21, wherein each of said at least one upper insert assembly is arranged such that said cap part of said upper insert assembly extends over one of said at least one lower insert assembly and said base part of said upper insert assembly extends rearward of said one of said at least one lower insert assembly.

24. A modular electrical connector assembly, comprising:

a receptacle housing having at least one plug-receiving receptacle, at least one insert assembly arranged in said receptacle housing and comprising:

an L-shaped insert housing having a bottom surface and a top surface, said receptacle being defined above said top surface, said insert housing comprising a base part having top and bottom surfaces, front and rear surfaces and opposed lateral surfaces, and a cap part having top and bottom surfaces, front and rear surfaces and opposed lateral surfaces, said bottom surface of said cap part partially overlying said top surface of said base part such that said cap part extends in a cantilever fashion from said base part, said base part including at least one projection on said top surface, said cap part having a recess for receiving said at least one projection, a first set of contact/terminal members each including a contact portion situated in said receptacle, a terminal portion extending beyond said bottom surface of said insert housing and an intermediate portion interconnecting said contact portion and said terminal portion, a second set of contact/terminal members each including a contact portion situated in said receptacle, a terminal portion extending beyond said bottom surface of said insert housing and an intermediate portion interconnecting said contact portion and said terminal portion, said contact/terminal members in said first set being parallel to and geometrically different than said contact/terminal members in said second set, and said insert housing defining a first set of conduits receiving said contact/terminal members in said first set of contact/terminal members and a second set of conduits receiving said contact/terminal members in said second set of contact/terminal members, said first and second sets of conduits being defined such that adjacent ones of said contact/terminal members received in said first and second sets of conduits are geometrically different from one another, each of said conduits in said first set of conduits comprising a bore arranged in said base part and extending between said top and bottom surfaces of said base part, a channel arranged in a respective one of said at least one projection on said base part, and a groove arranged in said front surface of said cap part and aligning with said channel, said channel being spaced from said groove such that said contact/terminal member has a step between said channel and said groove, a respective one of said contact/terminal members in said first set of contact/terminal members extending through said bore in said base part, through said channel on the respective one of said at least one projection, through said channel in said cap part and through said groove in said front surface of said cap part into said receptacle and then in said receptacle toward a rear of said receptacle housing to thereby constitute a rearward facing contact/terminal member.

25. A multi-level connector assembly for receiving multiple plugs including an outer housing part defining a plurality of plug-receiving receptacles arranged in upper and lower levels such that each of said upper and lower levels includes at least one of said receptacles, at least one lower insert assembly arranged in said outer housing part and including contact/terminal members and at least one upper insert assembly arranged in said outer housing part and including contact/terminal members, the improvement comprising:

said at least one upper insert assembly comprising an L-shaped insert housing having a bottom surface and a top surface, a respective one of said at least one receptacle in said upper level being defined above said top surface of said insert housing, said insert housing comprising a base part having top and bottom surfaces, front and rear surfaces and opposed lateral surfaces, and a cap part having top and bottom surfaces, front and rear surfaces and opposed lateral surfaces, said bottom surface of said cap part partially overlying said top surface of said base part such that said cap part extends in a cantilever fashion from said base part, a first set of contact/terminal members each including a contact portion situated in said receptacle, a terminal portion extending beyond said bottom surface of said insert housing and an intermediate portion interconnecting said contact portion and said terminal portion, a second set of contact/terminal members each including a contact portion situated in said receptacle, a terminal portion extending beyond said bottom surface of said insert housing and an intermediate portion interconnecting said contact portion and said terminal portion, said contact/terminal members in said first set being parallel to and geometrically different than said contact/terminal members in said second set, and said insert housing defining a first set of conduits receiving said contact/terminal members in said first set of contact/terminal members and a second set of conduits receiving said contact/terminal members in said second set of contact/terminal members, said first and second sets of conduits being defined such that adjacent ones of said contact/terminal members received in said first and second sets of conduits are geometrically different from one another, each of said conduits in said first set of conduits comprising a bore arranged in said base part and extending between said top and bottom surfaces of said base part, a channel arranged on said bottom surface of said cap part and extending from proximate said base part to adjacent said front surface of said cap part, and a groove arranged in said front surface of said cap part and aligning with said channel, a respective one of said contact/terminal members in said first set of contact/terminal members extending through said bore in said base part through said channel on said cap part and through said groove in said front surface of said cap part into said respective receptacle and then in said respective receptacle toward a rear of said outer housing part, each of said conduits in said second set of conduits comprising a first bore arranged in said base part and extending between said top and bottom surfaces of said base part, and a second bore arranged in said cap part and extending between said top and bottom surfaces of said cap part, said second bore aligning with said first bore in said base part, a respective one of said contact/terminal members in said second set of contact/terminal members extending through said first bore in said base part, through said second bore in said cap part, into said respective receptacle and then in said respective receptacle toward a front of said outer housing part.

26. The connector assembly of claim 25, wherein said at least one upper insert assembly further comprises a third set of contact/terminal members each including a contact portion extending into said respective receptacle in said upper level, a terminal portion extending beyond said bottom surface of said insert housing and an intermediate portion interconnecting said contact portion and said terminal portion, said intermediate portion of said contact/terminal members in said third set being different than said intermediate portion of said contact/terminal members in said first and second sets, said housing defining a third set of conduits for receiving said contact/terminal members in said third set of contact/terminal members, said conduits in said third set being different than said conduits in said first and second sets, said first, second and third sets of conduits being arranged in said insert such that adjacent ones of said contact/terminal members are geometrically different from one another.

27. The connector assembly of claim 25, wherein each of said at least one upper insert assembly is arranged such that said cap part of said insert housing of said upper insert assembly extends over one of said at least one lower insert assembly and said base part of said insert housing of said upper insert assembly extends rearward of said one of said at least one lower insert assembly.

* * * * *